US010916832B2

(12) United States Patent
Azad et al.

(10) Patent No.: US 10,916,832 B2
(45) Date of Patent: Feb. 9, 2021

(54) ELECTRONIC DEVICE SLOT ANTENNAS

(71) Applicant: Apple Inc., Cupertino, CA (US)

(72) Inventors: Umar Azad, Santa Clara, CA (US); Harish Rajagopalan, San Jose, CA (US); David Garrido Lopez, Campbell, CA (US); Rodney A. Gomez Angulo, Santa Clara, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 345 days.

(21) Appl. No.: 15/900,610

(22) Filed: Feb. 20, 2018

(65) Prior Publication Data

US 2019/0260112 A1 Aug. 22, 2019

(51) Int. Cl.
*H01Q 1/24* (2006.01)
*H01Q 1/52* (2006.01)
*H01Q 21/06* (2006.01)

(52) U.S. Cl.
CPC ..... *H01Q 1/243* (2013.01); *H01Q 1/523* (2013.01); *H01Q 21/064* (2013.01)

(58) Field of Classification Search
CPC ..... H01Q 1/243; H01Q 21/064
See application file for complete search history.

(56) References Cited

U.S. PATENT DOCUMENTS 7,612,725 B2 11/2009 Hill et al.
8,552,913 B2 10/2013 Ayatollahi et al.
9,024,823 B2 5/2015 Bevelacqua
9,768,506 B2 9/2017 Krogerus
9,825,352 B2 11/2017 Vance
2004/0257283 A1* 12/2004 Asano ..... H01Q 5/378 343/702
2012/0229347 A1* 9/2012 Jin ..... H01Q 7/00 343/702
2016/0211570 A1 7/2016 Jin et al.
2017/0048363 A1* 2/2017 Lee ..... H04B 1/3833
(Continued)

OTHER PUBLICATIONS

Jiangwei Zhong et al., "Multiband Slot Antennas for Metal Back Cover Mobile Handsets" Progress in Electromagnetics Research Letters, vol. 39, 115-126, 2013.
(Continued)

*Primary Examiner* — Ricardo I Magallanes
(74) *Attorney, Agent, or Firm* — Treyz Law Group, P.C.; Michael H. Lyons; Matthew R. Williams

(57) ABSTRACT

An electronic device may include first, second, and third antennas and conductive housing structures. The first, second, and third antennas may each include slots having open ends defined by gaps in the conductive housing structures. The second antenna may be interposed between the first and third antennas. The first and second antennas may convey signals at the same frequencies. The third antenna may convey signals at a lower frequency than the first and second antennas. A switch may be coupled across the third slot and may have a first state at which the switch forms a closed end of the third slot and a second state at which the third slot has two opposing open ends. Control circuitry may selectively activate one of two feeds for the third antenna and may adjust the switch so that the third antenna exhibits satisfactory antenna efficiency regardless of environmental conditions for the device.

19 Claims, 10 Drawing Sheets

(56) References Cited

U.S. PATENT DOCUMENTS

| | | | | |
|---|---|---|---|---|
| 2017/0077603 | A1* | 3/2017 | Krogerus | H01Q 5/10 |
| 2017/0201010 | A1 | 7/2017 | Kim et al. | |
| 2018/0062256 | A1 | 3/2018 | Kim et al. | |

OTHER PUBLICATIONS

Soo-Ji Lee et al., "Bandwidth enhanced tri-band monopole slot antenna on ultra-thin metal housed devices" INSPEC Accession No. 14847366; DOI: 10.1109/EuMIC.2014.6997919; Electronic ISBN: 978-2-8748-7036-1.

Erdinc Irci et al., U.S. Appl. No. 15/719,317, filed Sep. 28, 2017.

Harish Rajagopalan et al., U.S. Appl. No. 15/717,367, filed Sep. 27, 2017.

Harish Rajagopalan et al., U.S. Appl. No. 15/716,363, filed Sep. 26, 2017.

Enrique Ayala Vazquez et al., U.S. Appl. No. 15/657,001, filed Jul. 21, 2017.

Enrique Ayala Vazquez et al., U.S. Appl. No. 15/655,660, filed Jul. 20, 2017.

* cited by examiner

ELECTRONIC DEVICE SLOT ANTENNAS

BACKGROUND

This relates to electronic devices, and more particularly, to antennas for electronic devices with wireless communications circuitry.

Electronic devices such as portable computers and cellular telephones are often provided with wireless communications capabilities. To satisfy consumer demand for small form factor wireless devices, manufacturers are continually striving to implement wireless communications circuitry such as antenna components using compact structures. At the same time, there is a desire for wireless devices to cover a growing number of communications bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies and with a satisfactory efficiency bandwidth. In addition, in some devices a single antenna is used to cover a particular frequency band. However, in these scenarios, a single antenna may exhibit insufficient data throughput, particularly when handling communications for data-intensive device applications.

It would therefore be desirable to be able to provide improved wireless communications circuitry for wireless electronic devices.

SUMMARY

An electronic device may be provided with wireless circuitry and a housing having a peripheral conductive housing structures. The wireless circuitry may include first, second, and third antennas. The peripheral conductive housing structures may include a first wall, a second wall, and a third wall. The second wall may extend between ends of the first and third walls and the first wall may extend parallel to the third wall.

A first dielectric-filled gap may be formed in the first wall, a second dielectric-filled gap may be formed in the third wall, and a third dielectric-filled gap may be formed in the second wall. The first and third gaps may define a first segment of the peripheral conductive housing structures. The second and third gaps may define a second segment of the peripheral conductive housing structures. In another suitable arrangement, a fourth dielectric-filled gap may be formed in the second wall and the fourth and second gaps may define the second segment of the peripheral conductive housing structures. In this scenario, the fourth dielectric-filled gap may form an open end for the third slot. A conductive layer may extend between the first and second walls and may form an antenna ground for the first, second, and third antennas.

The first antenna may include a first slot between the first segment and the conductive layer and may include a first antenna feed coupled across the first slot. The first slot may have an open end defined by the first gap in the first wall. The second antenna may include a second slot between the first segment and the conductive layer and may include a second antenna feed coupled across the second slot. The second slot may have an open end defined by the third gap. The third antenna may include a third slot between second segment and the conductive layer and may include a third antenna feed coupled across the third slot. If desired, the first, second, and third slots may be formed from different portions of a single continuous slot at the exterior of the device that extends from the first gap to the second gap in the peripheral conductive housing structures. The first and second antennas may convey radio-frequency signals at the same frequencies such as frequencies in a cellular telephone midband and a cellular telephone high band using a multiple-input and multiple-output (MIMO) scheme. The third antenna may convey radio-frequencies at a lower frequency such as a frequency in a cellular telephone low band. The first, second, and third antennas may, if desired, perform wireless communications using a MIMO scheme with fourth, fifth, and sixth antennas located at an opposing side of the electronic device.

In one suitable arrangement, the third antenna may include a fourth antenna feed coupled across the third slot. A switch may be coupled between an end of the second segment and the conductive layer at the second dielectric-filled gap. The switch may have a first state at which the second dielectric-filled gap forms an additional open end of the third slot. The switch may have a second state at which the end of the second segment is shorted to the conductive layer (e.g., the switch may form a short circuit path across the second dielectric-filled gap that in turn forms a closed end of the third slot). Tunable components may be coupled between the second segment and the conductive layer across the third slot. Control circuitry in the electronic device may adjust the switch to shift the location of electromagnetic hotspots for the third antenna to desensitize the third antenna to loading from external objects such as a user's hand. The control circuitry may activate a selected one of the third and fourth antenna feeds at a given time, may adjust the state of the switch, and may adjust the tunable components based on the operating environment of the device so that the third antenna exhibits satisfactory antenna efficiency regardless of external loading conditions.

DETAILED DESCRIPTION

Figure 1:
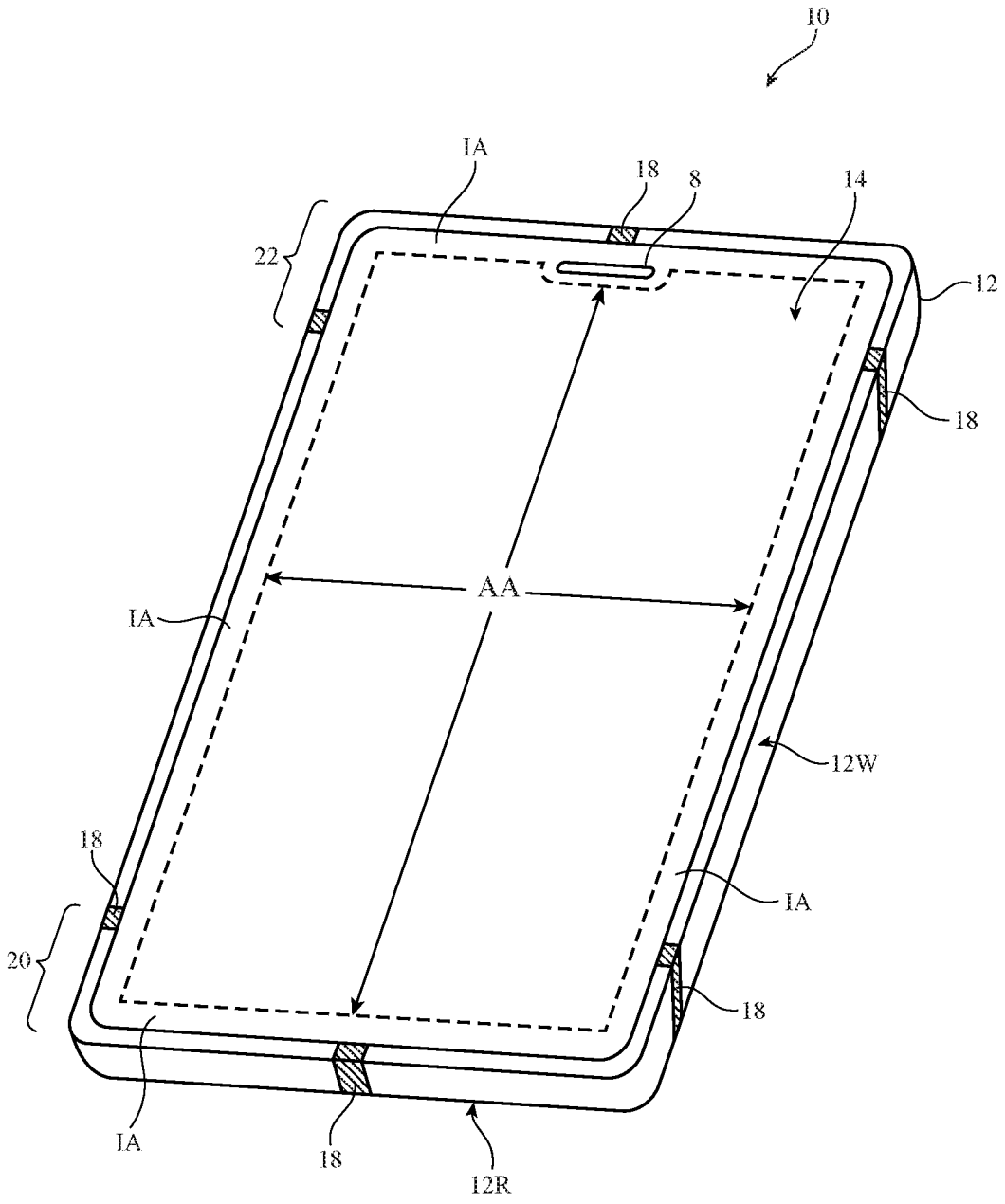
FIG. 1 is a perspective view of an illustrative electronic device in accordance with an embodiment.

An electronic device such as electronic device 10 of FIG. 1 may be provided with wireless circuitry that includes antennas. The antennas may be used to transmit and receive wireless signals.

The wireless circuitry of device 10 may handle one or more communications bands. For example, the wireless circuitry of device 10 may include a Global Position System (GPS) receiver that handles GPS satellite navigation system signals at 1575 MHz or a GLONASS receiver that handles GLONASS signals at 1609 MHz. Device 10 may also contain wireless communications circuitry that operates in communications bands such as cellular telephone bands and wireless circuitry that operates in communications bands such as the 2.4 GHz Bluetooth® band and the 2.4 GHz and 5 GHz Wi-Fi® wireless local area network bands (sometimes referred to as IEEE 802.11 bands or wireless local area network communications bands). Device 10 may also contain wireless communications circuitry for implementing near-field communications at 13.56 MHz or other near-field communications frequencies. If desired, device 10 may include wireless communications circuitry for communicating at 60 GHz, circuitry for supporting light-based wireless communications, or other wireless communications.

The wireless communications circuitry may include antenna structures. The antenna structures may include antennas for cellular telephone communications and/or other far-field (non-near-field) communications. The antenna structures may include loop antenna structures, inverted-F antenna structures, strip antenna structures, planar inverted-F antenna structures, slot antenna structures, hybrid antenna structures that include antenna structures of more than one type, or other suitable antenna structures. Conductive structures for the antenna structures may, if desired, be formed from conductive electronic device structures.

The conductive electronic device structures may include conductive housing structures. The housing structures may include peripheral structures such as peripheral conductive structures that run around the periphery of the electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Peripheral structures 12W and rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding lip that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

If desired, rear housing wall 12R may be formed from a metal such as stainless steel or aluminum and may sometimes be referred to herein as conductive rear housing wall 12R or conductive rear wall 12R. Conductive rear housing wall 12R may lie in a plane that is parallel to display 14. In configurations for device 10 in which rear housing wall 12R is formed from metal, it may be desirable to form parts of peripheral conductive housing structures 12W as integral portions of the housing structures forming the conductive rear housing wall of housing 12. For example, conductive rear housing wall 12R of device 10 may be formed from a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Conductive rear housing wall 12R may have one or more, two or more, or three or more portions. Peripheral conductive housing structures 12W and/or the conductive rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide structures 12W and/or 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layers in display 14 that overlaps inactive area IA may be coated with an opaque masking layer in inactive area IA. The opaque masking layer may have any suitable color.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 8 or a microphone port. Openings may be formed in housing 12 to form communications ports (e.g., an audio jack port, a digital data port, etc.) and/or audio ports for audio components such as a speaker and/or a microphone if desired.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of member 16). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 12W and opposing conductive ground structures such as conductive portions of conductive rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22.

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. There may be, for example, two peripheral conductive segments in peripheral conductive housing structures 12W (e.g., in an arrangement with two of gaps 18), three peripheral conductive segments (e.g., in an arrangement with three of gaps 18), four peripheral conductive segments (e.g., in an arrangement with four of gaps 18), six peripheral conductive segments (e.g., in an arrangement with six gaps 18), etc. The segments of peripheral conductive housing structures 12W that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 12W and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have one or more upper antennas and one or more lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, etc.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area of regions 20 and 22 that is available for forming antennas within device 10. In general, antennas that are provided with larger operating volumes or spaces may have higher bandwidth efficiency than antennas that are provided with smaller operating volumes or spaces. If care is not taken, increasing the size of active area AA may reduce the operating space available to the antennas, which can undesirably inhibit the efficiency bandwidth of the antennas (e.g., such that the antennas no longer exhibit satisfactory radio-frequency performance). It would therefore be desirable to be able to provide antennas that occupy a small amount of space within device 10 (e.g., to allow for as large of a display active area AA as possible) while still allowing the antennas to operate with optimal efficiency bandwidth.

Figure 2:
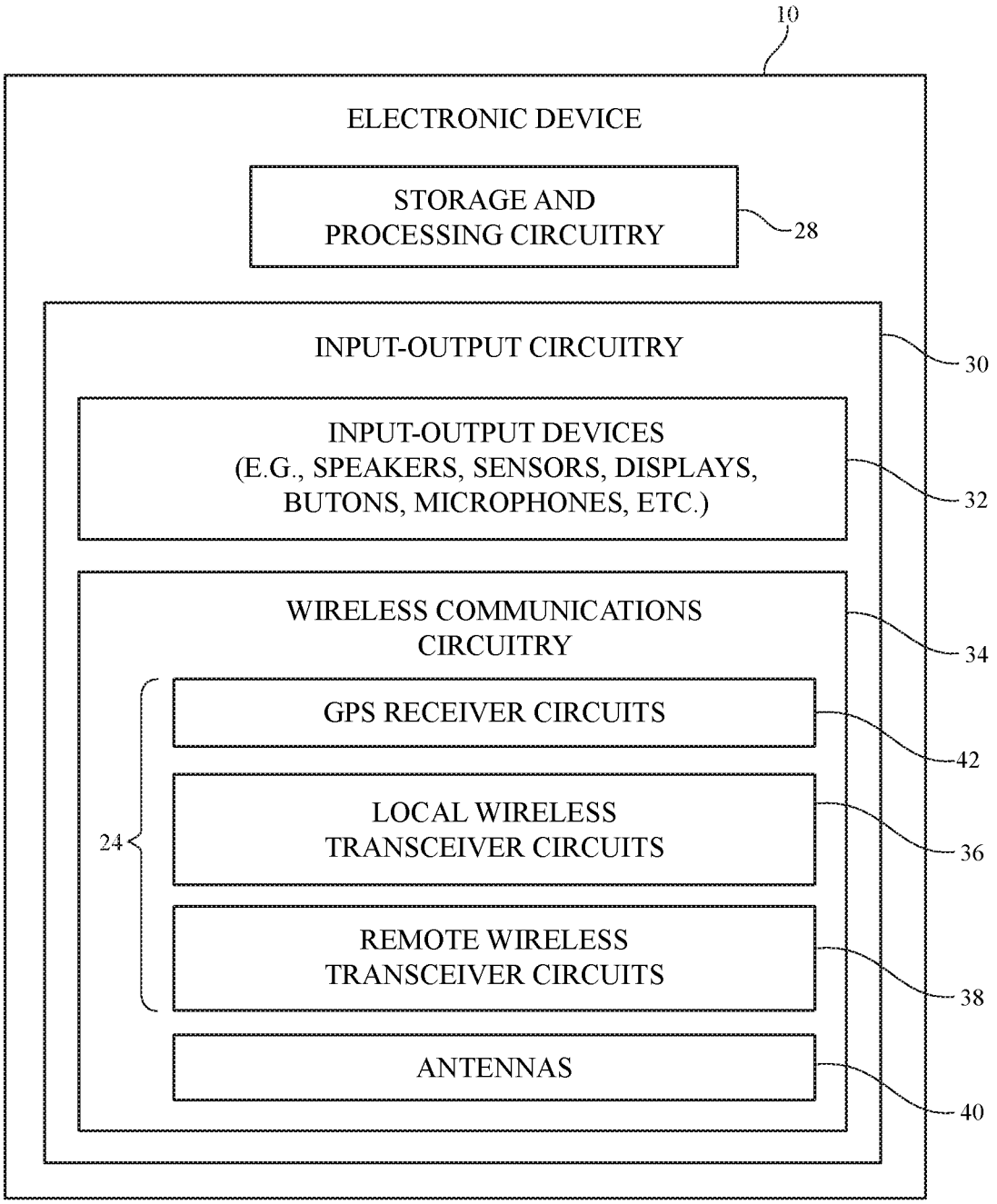
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as Wi-Fi®), protocols for other short-range wireless communications links such as the Bluetooth® protocol or other wireless personal area network protocols, cellular telephone protocols, multiple-input and multiple-output (MIMO) protocols, antenna diversity protocols, near-field communications (NFC) protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors (e.g., a fingerprint sensor integrated with a button), etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 24 for handling various radio-frequency communications bands. For example, circuitry 34 may include transceiver circuitry 36, 38, and 42. Transceiver circuitry 36 may handle wireless local area network (WLAN) bands such as 2.4 GHz and 5 GHz bands for Wi-Fi® (IEEE 802.11) communications and/or wireless personal area network (WPAN) bands such as the 2.4 GHz Bluetooth® communications band. Circuitry 34 may use cellular telephone transceiver circuitry 38 for handling wireless communications in frequency ranges such as a low communications band from 700 to 960 MHz, a low-midband from 960 to 1710 MHz, a midband from 1710 to 2170 MHz, a high band from 2300 to 2700 MHz, an ultra-high band from 3400 to 3700 MHz or other communications bands between 600 MHz and 4000 MHz or other suitable frequencies (as examples).

Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include satellite navigation receive equipment such as global positioning system (GPS) receiver circuitry 42 for receiving GPS signals at 1575 MHz or for handling other satellite positioning data (e.g., Global Navigation Satellite System (GLONASS) signals, etc.). In Wi-Fi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
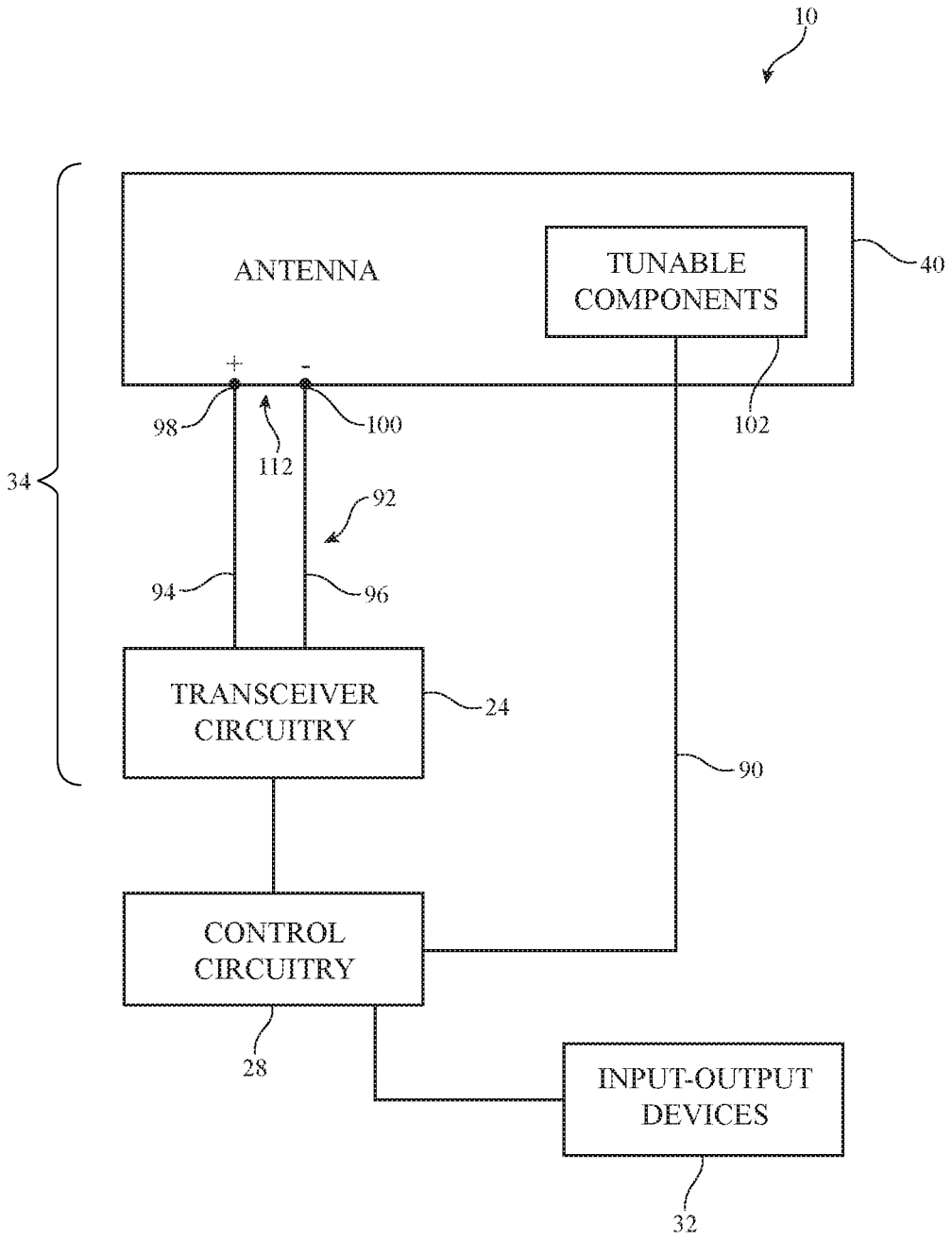
FIG. 3 is a schematic diagram of illustrative wireless communications circuitry in accordance with an embodiment.

As shown in FIG. 3, transceiver circuitry 24 in wireless communications circuitry 34 may be coupled to a given antenna 40 using paths such as path 92. Wireless communications circuitry 34 may be coupled to control circuitry 28. Control circuitry 28 may be coupled to input-output devices 32. Input-output devices 32 may supply output from device 10 and may receive input from sources that are external to device 10.

To provide antenna structures such as antenna 40 with the ability to cover communications frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components 102 to tune antennas over communications bands of interest. Tunable components 102 may be part of a tunable filter or tunable impedance matching network, may be part of an antenna resonating element, may span a gap between an antenna resonating element and antenna ground, etc.

Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 90 that adjust inductance values, capacitance values, or other parameters associated with tunable components 102, thereby tuning antenna 40 to cover desired communications bands.

Path 92 may include one or more transmission lines. As an example, path 92 of FIG. 3 may be a radio-frequency transmission line having a positive signal conductor such as conductor 94 and a ground signal conductor such as conductor 96. Transmission line structures used to form path 92 (sometimes referred to herein as transmission lines 92 or radio-frequency transmission lines 92) may include parts of a coaxial cable, a stripline transmission line, microstrip transmission line, coaxial probes realized by metalized vias, edge-coupled microstrip transmission lines, edge-coupled stripline transmission lines, waveguide structures, transmission lines formed from combinations of transmission lines of these types, etc.

Transmission lines in device 10 may be integrated into rigid and/or flexible printed circuit boards. In one suitable arrangement, transmission lines in device 10 may also include transmission line conductors (e.g., signal and ground conductors) integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network (e.g., an adjustable matching network formed using tunable components 102) may include components such as inductors, resistors, and capacitors used in matching the impedance of antenna 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna 40 and may be tunable and/or fixed components.

Transmission line 92 may be coupled to antenna feed structures associated with antenna 40. As an example, antenna 40 may form an inverted-F antenna, a slot antenna, a hybrid inverted-F slot antenna or other antenna having an antenna feed 112 with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 100. Other types of antenna feed arrangements may be used if desired. For example, antenna 40 may be fed using multiple feeds (e.g., switchable feeds where a selected feed may be switched into use at any given time). The illustrative feeding configuration of FIG. 3 is merely illustrative. In scenarios where electronic device 10 includes multiple antennas 40, each antenna 40 may include its own antenna feed 112 and a corresponding transmission line 92, for example.

Control circuitry 28 may use information from a proximity sensor (see, e.g., sensors 32 of FIG. 2), wireless performance metric data such as received signal strength information, device orientation information from an orientation sensor, device motion data from an accelerometer or other motion detecting sensor, information about a usage scenario of device 10, information about whether audio is being played through a speaker, information from one or more antenna impedance sensors, and/or other information in determining when antenna 40 is being affected by the presence of nearby external objects or is otherwise in need of tuning. In response, control circuitry 28 may adjust an adjustable inductor, adjustable capacitor, switch, or other tunable component 102 and/or may switch one or more antennas 40 into or out of use to ensure that wireless communications circuitry 34 operates as desired.

The presence or absence of external objects such as a user's hand may affect antenna loading and therefore antenna performance. Antenna loading may differ depending on the way in which device 10 is being held. For example, antenna loading and therefore antenna performance may be affected in one way when a user is holding device 10 in a portrait orientation and may be affected in another way when a user is holding device 10 in a landscape orientation. To accommodate various loading scenarios, device 10 may use sensor data, antenna measurements, information about the usage scenario or operating state of device 10, and/or other data from input-output devices 32 to monitor for the presence of antenna loading (e.g., the presence of a user's hand, the user's head, or another external object). Device 10 (e.g., control circuitry 28) may then adjust tunable components 102 in antenna 40 and/or may switch other antennas into or out of use to compensate for the loading (e.g., multiple antennas 40 may be operated using a diversity protocol to ensure that at least one antenna 40 may maintain satisfactory communications even while the other antennas are blocked by external objects). Adjustments to tunable components 102 may also be made to extend the coverage of antenna structures 40 (e.g., to cover desired communications bands that extend over a range of frequencies larger than the antenna structures would cover without tuning).

In the example of FIG. 3, a single antenna is shown. When operating using a single antenna, a single stream of wireless data may be conveyed between device 10 and external communications equipment (e.g., one or more other wireless devices such as wireless base stations, access points, cellular telephones, computers, etc.). This may impose an upper limit on the data rate (data throughput) obtainable by wireless communications circuitry 34 in communicating with the external communications equipment. As software applications and other device operations increase in complexity over time, the amount of data that needs to be conveyed between device 10 and the external communications equipment typically increases, such that a single antenna may not be capable of providing sufficient data throughput for handling the desired device operations.

In order to increase the overall data throughput of wireless communications circuitry 34, multiple antennas may be operated using a multiple-input and multiple-output (MIMO) scheme. When operating using a MIMO scheme, two or more antennas on device 10 may be used to convey multiple independent streams of wireless data at the same frequencies. This may significantly increase the overall data throughput between device 10 and the external communications equipment relative to scenarios where only a single antenna is used. In general, the greater the number of antennas that are used for conveying wireless data under the MIMO scheme, the greater the overall throughput of circuitry 34.

Figure 4:
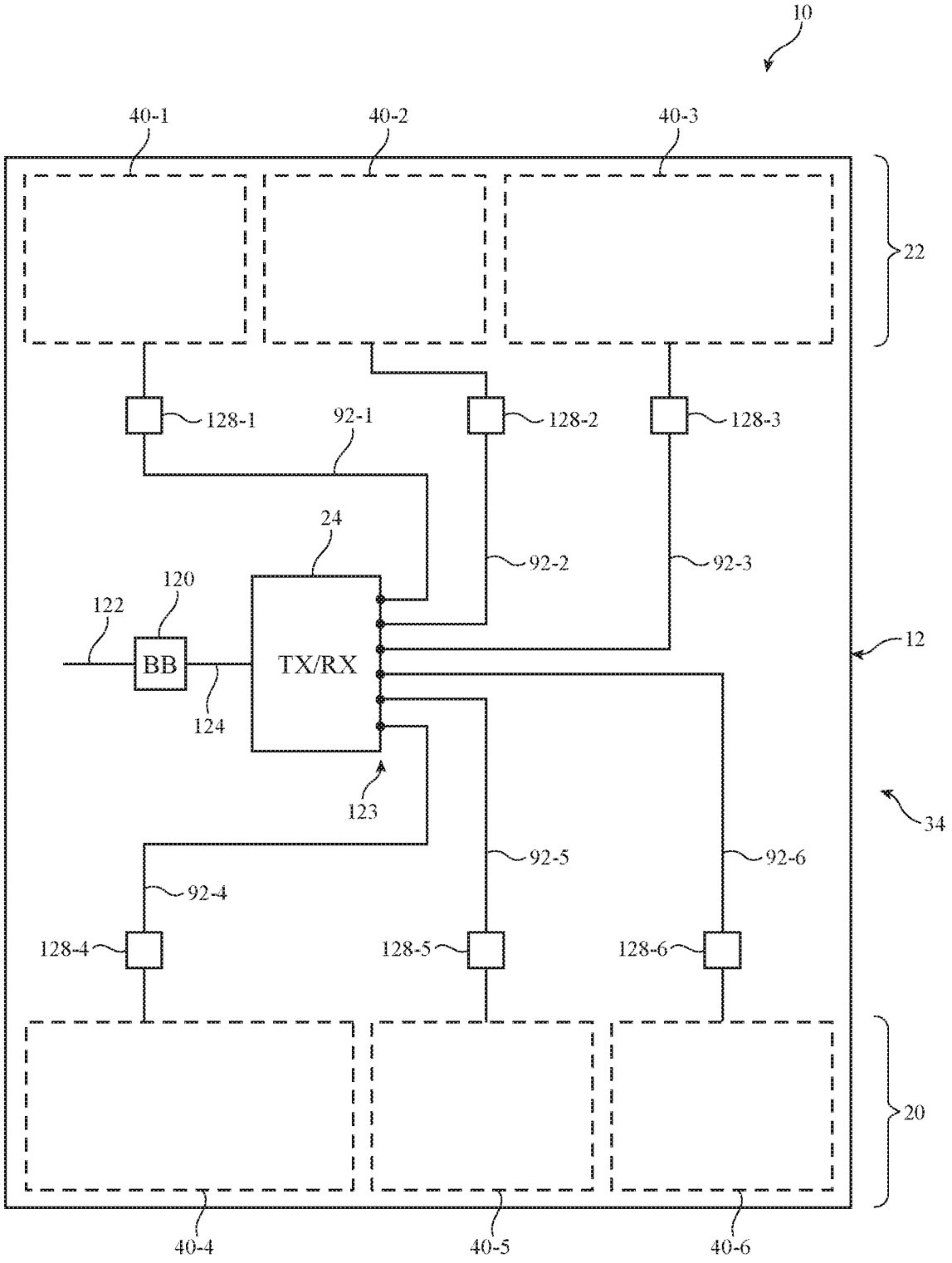
FIG. 4 is a diagram of illustrative wireless circuitry including multiple antennas for performing multiple-input and multiple-output (MIMO) communications in accordance with an embodiment.

FIG. 4 is a diagram showing how device 10 may include multiple antennas 40 for performing wireless communications (e.g., using a MIMO scheme). As shown in FIG. 4, device 10 may include two or more antennas 40 such as a first antenna 40-1, a second antenna 40-2, a third antenna 40-3, a fourth antenna 40-4, a fifth antenna 40-5, and a sixth antenna 40-6. This example is merely illustrative and, in general, device 10 may include nay desired number of antennas 40.

Antennas 40 may be provided at different locations within housing 12 of device 10. For example, antennas 40-1, 40-2, and 40-3 may be formed within region 22 at a first (upper) end of housing 12 whereas antennas 40-4, 40-5, and 40-6 are formed within region 20 at an opposing second (lower) end of housing 12. In the example of FIG. 3, housing 12 has a rectangular periphery (e.g., a periphery having four corners) and each of antennas 40-1, 40-3, 40-4, and 40-6 are formed at a respective corner of housing 12. This example is merely illustrative and, in general, antennas 40 may be formed at any desired location within housing 12.

Wireless communications circuitry 34 may include input-output ports such as port 122 for interfacing with digital data circuits in storage and processing circuitry (e.g., storage and processing circuitry 28 of FIG. 2). Wireless communications circuitry 34 may include baseband circuitry such as baseband (BB) processor 120 and radio-frequency transceiver circuitry such as transceiver circuitry 24.

Port 122 may receive digital data from storage and processing circuitry that is to be transmitted by transceiver circuitry 24. Incoming data that has been received by transceiver circuitry 24 and baseband processor 120 may be supplied to storage and processing circuitry via port 122.

Transceiver circuitry 24 may include one or more discrete transmitters and one or more discrete receivers if desired. Transceiver circuitry 24 may include multiple transceiver ports 123 that are each coupled to a corresponding transmission line 92 (e.g., a first transmission line 92-1, a second transmission line 92-2, a third transmission line 92-3, a fourth transmission line 92-4, a fifth transmission line 92-5, and a sixth transmission line 92-6). Transmission line 92-1 may couple a first transceiver port 123 of transceiver circuitry 24 to antenna 40-1. Transmission line 92-2 may couple a second transceiver port 123 of transceiver circuitry 24 to antenna 40-2. Similarly, transmission lines 92-3, 92-4, 92-5, and 92-6 may couple corresponding ports 123 of transceiver circuitry 24 to antennas 40-3, 40-4, 40-5, and 40-6, respectively.

Radio-frequency front end circuits 128 may be interposed on each transmission line 92 (e.g., a first front end circuit 128-1 may be interposed on transmission line 92-1, a second front end circuit 128-2 may be interposed on transmission line 92-2, a third front end circuit 128-3 may be interposed on transmission line 92-3, etc.). Front end circuits 128 may each include switching circuitry, filter circuitry (e.g., duplexer and/or diplexer circuitry, notch filter circuitry, low pass filter circuitry, high pass filter circuitry, bandpass filter circuitry, etc.), impedance matching circuitry for matching the impedance of transmission line 92 to the corresponding antenna 40, networks of active and/or passive components such as tunable components 102 of FIG. 3, radio-frequency coupler circuitry for gathering antenna impedance measurements, or any other desired radio-frequency circuitry. If desired, front end circuits 128 may include switching circuitry that is configured to selectively couple antennas 40-1, 40-2, 40-3, 40-4, 40-5, and 40-6 to different respective transceiver ports 123 (e.g., so that each antenna can handle communications for different transceiver ports 123 over time based on the state of the switching circuits in front end circuits 128).

If desired, front end circuits 128 may include filtering circuitry (e.g., duplexers and/or diplexers) that allow the corresponding antenna 40 to transmit and receive radio-frequency signals at the same time (e.g., using a frequency domain duplexing (FDD) scheme). Antennas 40-1, 40-2, 40-3, 40-4, 40-5, and 40-6 may transmit and/or receive radio-frequency signals in respective time slots or two or more of antennas 40-1, 40-2, 40-3, 40-4, 40-5, and 40-6 may transmit and/or receive radio-frequency signals concurrently. In general, any desired combination of antennas may transmit and/or receive radio-frequency signals at a given time.

Amplifier circuitry such as one or more power amplifiers may be interposed on transmission lines 92 and/or formed within transceiver circuitry 24 for amplifying radio-frequency signals output by transceiver circuitry 24 prior to transmission over antennas 40. Amplifier circuitry such as one or more low noise amplifiers may be interposed on transmission lines 92 and/or formed within transceiver circuitry 24 for amplifying radio-frequency signals received by antennas 40 prior to conveying the received signals to transceiver circuitry 24.

In the example of FIG. 4, separate front end circuits 128 are formed on each transmission line 92. This is merely illustrative. If desired, two or more transmission lines 92 may share the same front end circuits 128 (e.g., front end circuits 128 may be formed on the same substrate, module, or integrated circuit).

Transceiver circuitry 24 may, for example, include circuitry for converting baseband signals received from baseband processor 120 over path 124 into corresponding radio-frequency signals. For example, transceiver circuitry 24 may include mixer circuitry for up-converting the baseband signals to radio-frequencies prior to transmission over antennas 40. Transceiver circuitry 24 may include digital to analog converter (DAC) and/or analog to digital converter (ADC) circuitry for converting signals between digital and analog domains. Transceiver circuitry 24 may include circuitry for converting radio-frequency signals received from antennas 40 over transmission lines 92 into corresponding baseband signals. For example, transceiver circuitry 24 may include mixer circuitry for down-converting the radio-frequency signals to baseband frequencies prior to conveying the baseband signals to baseband processor 120 over paths 124. Baseband circuitry 120, front end circuits 128, and/or transceiver circuitry 24 may be formed on the same substrate, integrated circuit, integrated circuit package, or module or two or more of these components may be formed on separate substrates, integrated circuits, integrated circuit packages, or modules.

In the example of FIG. 4, antennas 40-3 and 40-4 may occupy a larger space (e.g., a larger area or volume within device 10) than antennas 40-1, 40-2, 40-5, and 40-6. This may allow antennas 40-3 and 40-4 to support communications at longer wavelengths (i.e., lower frequencies) than antennas 40-1, 40-2, 40-5, and 40-6. This is merely illustrative and, if desired, each of the antennas may occupy the same volume or may occupy different volumes. Antennas 40-1, 40-2, 40-3, 40-4, 40-5, and/or 40-6 may be configured to convey radio-frequency signals in at least one common frequency band. If desired, one or more of antennas 40-1, 40-2, 40-3, 40-4, 40-5, and 40-6 may handle radio-frequency signals in at least one frequency band that is not covered by one or more of the other antennas in device 10.

If desired, each antenna 40 may handle radio-frequency communications in multiple frequency bands (e.g., multiple cellular telephone communications bands). In one suitable arrangement that is sometimes described herein as an example, antennas 40-3 and 40-4 may each handle radio-frequency signals in a first frequency band such as a cellular telephone low band between about 600 MHz and about 960 MHz. Antennas 40-1, 40-2, 40-5, and 40-6 may each handle radio-frequency signals in a second frequency band such as a cellular telephone midband between about 1700 MHz and 2200 MHz and in a third frequency band such as a cellular telephone high band between about 2300 MHz and about 2700 MHz. The example of FIG. 4 is merely illustrative. In general, antennas 40 may cover any desired frequency bands. Device 10 may include any desired number of antennas 40. Housing 12 may have any desired shape.

In order to perform wireless communications under a MIMO scheme, antennas 40 need to convey data at the same frequencies. If desired, wireless communications circuitry 34 may perform so-called two-stream (2×) MIMO operations (sometimes referred to herein as 2× MIMO communications or communications using a 2× MIMO scheme) in which two antennas 40 are used to convey two independent streams of radio-frequency signals at the same frequency. Wireless communications circuitry 34 may perform so-called four-stream (4×) MIMO operations (sometimes referred to herein as 4× MIMO communications or communications using a 4× MIMO scheme) in which four antennas 40 are used to convey four independent streams of radio-frequency signals at the same frequency. Performing 4× MIMO operations may support higher overall data throughput than 2× MIMO operations because 4× MIMO operations involve four independent wireless data streams whereas 2× MIMO operations involve only two independent wireless data streams. If desired, antennas 40-1, 40-2, 40-5, and 40-6 may perform up to 4× MIMO operations in the one or more frequency bands such as in the cellular telephone midband (sometimes referred to herein as cellular midband MB) and the cellular telephone high band (sometimes referred to herein as cellular high band HB). In another possible arrangement, two of antennas 40-1, 40-2, 40-5, and 40-6 may alternatively perform 2× MIMO operations in the cellular midband and/or the cellular high band. Antennas 40-3 and 40-4 may perform 2× MIMO operations in one or more frequency bands such as in the cellular telephone low band (sometimes referred to herein as cellular low band LB). In this way, antennas 40-1 through 40-6 may perform MIMO operations to greatly increase the possible data throughput of wireless communications circuitry 34.

Antennas 40 (e.g., antennas 40-1, 40-2, 40-3, 40-4, 40-5, and/or 40-6 of FIG. 4) may include slot antenna structures, inverted-F antenna structures (e.g., planar and non-planar inverted-F antenna structures), loop antenna structures, combinations of these, or any other desired antenna structures. In one suitable arrangement that is described herein as an example, antennas 40 may be formed using slot antenna structures.

Figure 5:
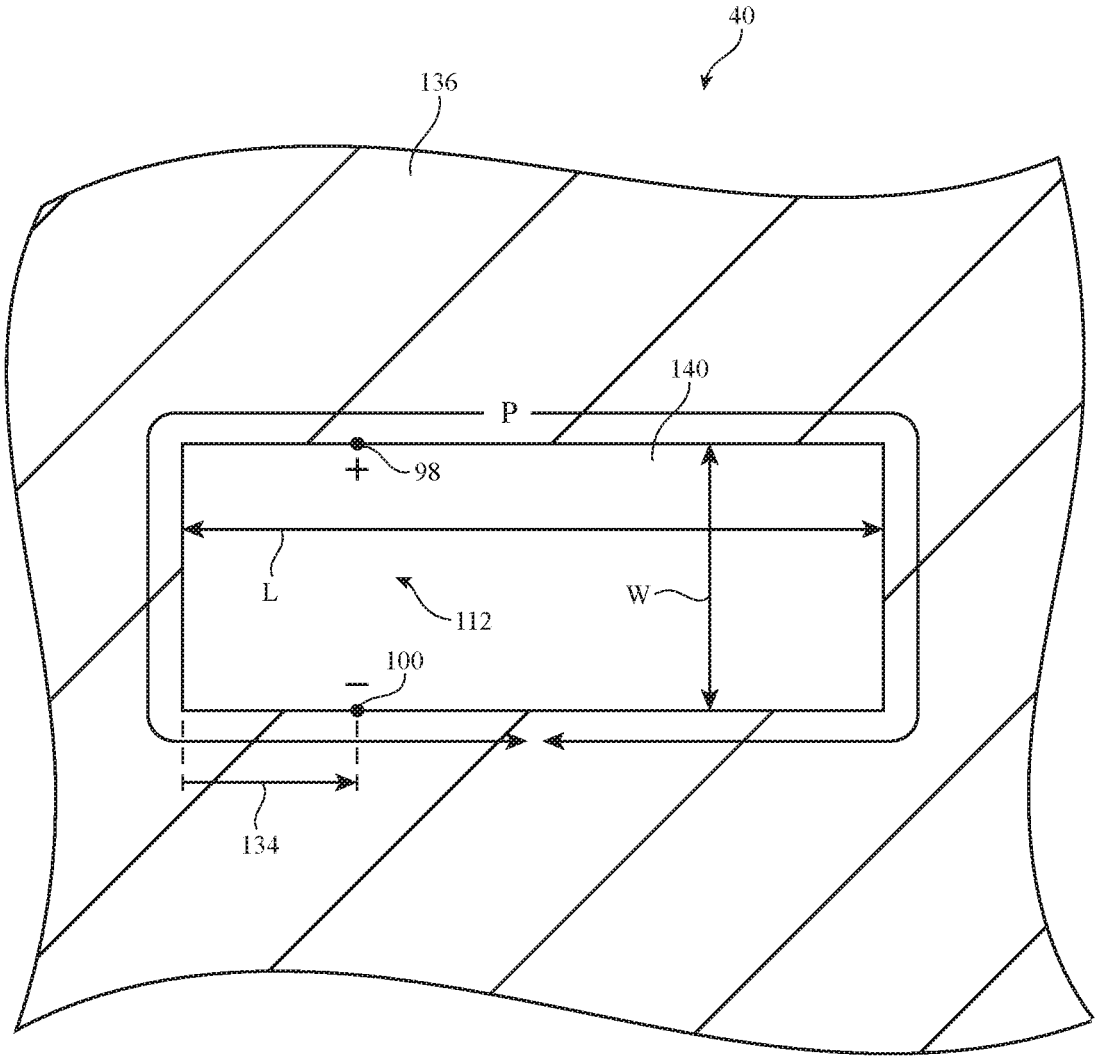
FIG. 5 is a diagram of illustrative slot antenna structures in accordance with an embodiment.

An illustrative slot antenna structure that may be used for forming antennas 40 is shown in FIG. 5. As shown in FIG. 5, antenna 40 (e.g., a given one of antennas 40-1, 40-2, 40-3, 40-4, 40-5, and 40-6 of FIG. 4) may include a conductive structure such as structure 136 that has been provided with a dielectric-filled opening such as dielectric opening 140. Openings such as opening 140 of FIG. 5 are sometimes referred to as slots, slot elements, slot radiating elements, slot resonating elements, or slot antenna resonating elements of antenna 40. In the configuration of FIG. 5, slot 140 is a closed slot, because portions of conductive structure 136 completely surround and enclose slot 140. Open slot antenna structures may also be formed in conductive materials such as conductive structure 136 (e.g., by forming an opening in the right-hand left-hand end of conductive structure 136 so that slot 140 protrudes through conductive structure 136).

Antenna feed 112 for antenna 40 may be formed using positive antenna feed terminal 98 and ground antenna feed terminal 100. In general, the frequency response of an antenna is related to the size and shapes of the conductive structures in the antenna. Slot antenna structures of the type shown in FIG. 4 tend to exhibit response peaks when slot perimeter P is equal to the wavelength of operation of the antenna (e.g. where perimeter P is equal to two times length L plus two times width W). Antenna currents may flow between antenna feed terminals 98 and 100 around perimeter P of slot 140.

Antenna feed 112 may be coupled across slot 140 at a location along elongated length L. For example, antenna feed 112 may be located at a distance 134 from one side of slot 140. Distance 134 may be adjusted to match the impedance of antenna 40 to the impedance of the corresponding transmission line (e.g., transmission line 92 of FIG. 3). For example, the antenna current flowing around slot 140 may experience an impedance of zero at the left and right edges of slot 140 (e.g., a short circuit impedance) and an infinite (open circuit) impedance at the center of slot 140 (e.g., at a fundamental frequency of the slot). Location 134 may be located between the center of slot 140 and the left edge at a location where the antenna current experiences an impedance that matches the impedance of the corresponding transmission line, for example (e.g., distance 134 may be between 0 and ¼ of the wavelength of operation of antenna structures 40). Distance 134 may, for example, be 9 mm, between 5 mm and 10 mm, between 2 mm and 12 mm, or any other suitable distance. Slot 140 may have a width W perpendicular to length L.

In scenarios where slot 140 is a closed slot, length L may be approximately equal to (e.g., within 15% of) one half of a wavelength of operation of the antenna (e.g., a wavelength of a fundamental mode of the antenna). Harmonic modes of slot 140 may also be configured to cover desired frequency bands. In scenarios where slot 140 is an open slot, the length of slot element 140 may be approximately equal to one quarter of the wavelength of the antenna. The wavelength of operation may, for example, be an effective wavelength of operation based on the dielectric material within slot 140.

The frequency response of slot 140 can be tuned using one or more tuning components (e.g., tunable components 102 of FIG. 3). These components may have terminals that are coupled to opposing sides of slot 140 (i.e., the tunable components may bridge the slot). If desired, tunable components may have terminals that are coupled to respective locations along the length of one of the sides of slot 140. Combinations of these arrangements may also be used. Antenna 40 may sometimes be referred to herein as slot antenna 40.

The example of FIG. 5 is merely illustrative. In general, slot 140 may have any desired shape (e.g., where the perimeter P of slot 140 defines radiating characteristics of the antenna). For example, slot 140 may have a meandering shape with different segments extending in different directions, may have straight and/or curved edges, may have more than one open end, etc. Conductive structure 136 may be formed from any desired conductive electronic device structures. For example, conductive structure 136 may include conductive traces on printed circuit boards or other substrates, sheet metal, metal foil, conductive structures associated with display 14 (FIG. 1), conductive portions of housing 12 (e.g., conductive structures 12W and/or 12R of FIG. 1), and/or other conductive structures within device 10. In one suitable arrangement, different sides (edges) of slot 140 may be defined by different conductive structures.

Figure 6:
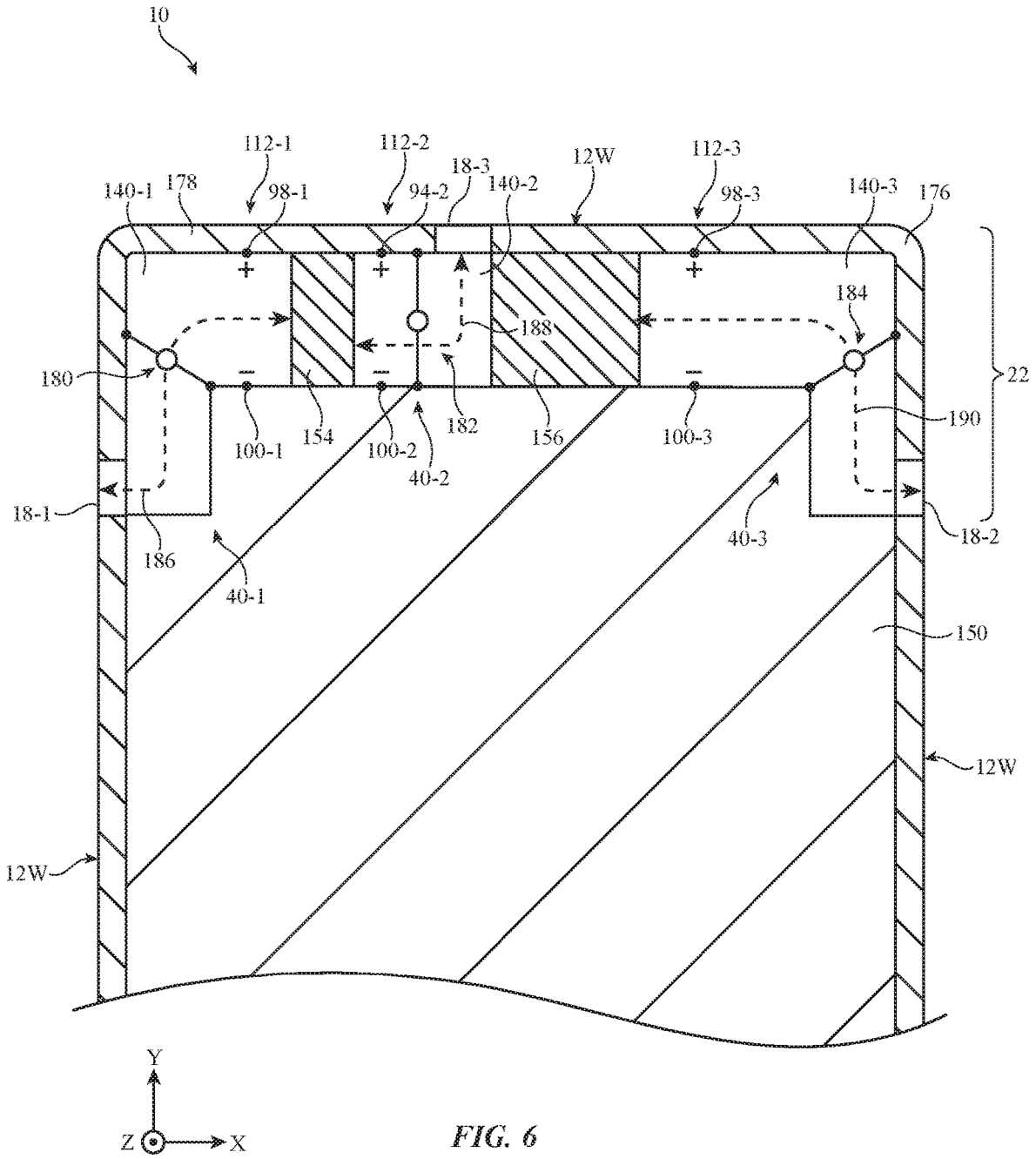
FIGS. 6 and 7 are top views of illustrative slot antennas in an electronic device that can be used to cover multiple frequency bands using a MIMO scheme in accordance with an embodiment.

FIG. 6 is a top interior view of upper end 22 of device 10 in which antennas 40-1, 402-, and 40-3 (FIG. 3) are located for performing wireless communications using a MIMO scheme. As shown in FIG. 6, device 10 may have peripheral conductive housing structures such as peripheral conductive housing structures 12W (sometimes referred to herein as peripheral conductive housing sidewalls 12W). In the example of FIG. 6, display 14 is not shown for the sake of clarity.

Peripheral conductive housing sidewalls 12W may be segmented by dielectric-filled gaps (e.g., plastic gaps) 18 such as a first gap 18-1, a second gap 18-2, and a third gap 18-3. Each of gaps 18-1, 18-2, and 18-3 may be formed within peripheral conductive housing sidewalls 12W along respective sides of device 10. Gap 18-1 may separate segment 178 of peripheral conductive housing sidewalls 12W from the segment of peripheral conductive housing sidewalls 12W below gap 18-1. Gap 18-2 may separate segment 176 of peripheral conductive housing sidewalls 12W from the segment of peripheral conductive housing sidewalls 12W below gap 18-2. Gap 18-3 may separate segment 178 from segment 176 of peripheral conductive housing sidewalls 12W. Gaps 18-1, 18-2, and 18-3 may be filled with plastic, ceramic, sapphire, glass, epoxy, or other dielectric materials. The dielectric material in gaps 18-1, 18-2, and 18-3 may lie flush with peripheral conductive housing sidewalls 12W at the exterior surface of device 10 if desired.

A conductive structure such as conductive layer 150 may extend between opposing peripheral conductive housing sidewalls 12W. Conductive layer 150 may be formed from conductive housing structures, conductive structures from electrical device components in device 10, printed circuit board traces, strips of conductor such as strips of wire and metal foil, conductive components in a display (e.g., display 14 of FIG. 1), and/or other conductive structures (e.g., conductive layer 150 need not be confined to a single plane). In one suitable arrangement, conductive layer 150 is formed from conductive rear wall 12R (FIG. 1).

As shown in FIG. 6, conductive layer 150 (e.g., conductive rear housing wall 12R) may extend between the opposing edges (e.g., the left and right edges) of device 10. Conductive layer 150 may be formed from a separate metal structure from peripheral conductive housing sidewalls 12W or conductive layer 150 and peripheral conductive housing sidewalls 12W may be formed from the same, continuous, integral metal structure (e.g., in a unibody configuration).

Antennas 40-1, 40-2, and 40-3 may be implemented using slot antenna structures of FIG. 5 and may therefore sometimes be referred to herein as slot antennas 40-1, 40-2, and 40-3. Conductive layer 150 and the segments of peripheral conductive housing walls 12W below gaps 18-1 and 18-2 may be held at a ground potential and may form an antenna ground (sometimes referred to herein as a ground plane) for antennas 40-1, 40-2 and 40-3.

Antenna 40-1 may include a first slot 140-1 between segment 178 of peripheral conductive housing sidewalls 12W and conductive layer 150. Antenna 40-2 may include a second slot 140-2. Second slot 140-2 may have a first edge defined by portions of segment 178 and, if desired, a portion of segment 176 of peripheral conductive housing sidewalls 12W. Second slot 140-2 may have a second opposing edge defined by conductive layer 150. Antenna 40-3 may include a third slot 140-3 between segment 176 of peripheral conductive housing sidewalls 12W and conductive layer 150 (e.g., conductive layer 150 and peripheral conductive housing sidewalls 12W may form conductive structure 136 of FIG. 5 for antennas 40-1, 40-2, and 40-3).

Conductive bridging structures such as conductive structures 154 may be coupled between segment 178 of peripheral conductive housing sidewalls 12W and conductive layer 150. Conductive structures 154 may electrically isolate slot 140-1 from slot 140-2 (e.g., conductive structures 154 may define edges or closed ends of slots 140-1 and 140-2). Conductive bridging structures such as conductive structures 156 may be coupled between segment 176 of peripheral conductive housing sidewalls 12W and conductive layer 150. Conductive structures 156 may electrically isolate slot 140-2 from slot 140-3 (e.g., conductive structures 154 may define edges or closed ends of slots 140-2 and 140-3).

Conductive structures 154 and 156 may, as examples, be formed from metal traces on printed circuits, metal foil, metal members formed from a sheet of metal, conductive portions of housing 12 (e.g., integral portions of conductive rear housing wall 12R and/or peripheral conductive housing sidewalls 12W), conductive wires, conductive portions of input-output devices 32 of FIG. 2 (e.g., conductive portions of display 14, conductive portions of a camera module or light sensor module, conductive portions of a speaker module, conductive portions of a data port such as a universal serial bus port, etc.), conductive interconnect structures such as conductive pins, conductive brackets, conductive adhesive, solder, welds, conductive springs, conductive screws, or combinations of these and/or other conductive interconnect structures, conductive foam, switchable or fixed inductive paths (e.g., one or more switchable inductors), switchable or fixed capacitive paths (e.g., one or more switchable capacitors), and/or any other desired conductive components or structures. Conductive structures 154 need not be formed from the same types of conductive components as conductive structures 156.

In one suitable arrangement, conductive structures 156 includes a conductive portion of a camera module for device 10 and a capacitive circuit that is interposed between the conductive portion of the camera module and gap 18-3. The capacitive circuit may, for example, have a capacitance that configures the capacitive circuit to form a short circuit between segment 176 and conductive layer 150 at relatively high frequencies such as cellular telephone frequencies above 600 MHz and that configures the capacitive circuit to form an open circuit lower frequencies such as near-field communications frequencies at 13.56 MHz.

Slots 140-1, 140-2, and 140-3 may be filled with plastic, glass, sapphire, epoxy, ceramic, or other dielectric material. Slot 140-1 may be continuous with gap 18-1 in peripheral conductive housing sidewalls 12W such that slot 140-1 is an open slot having an open end formed by (defined by) gap 18-1 (e.g., a single piece of dielectric material may be used to fill both slot 140-1 and gap 18-1). Slot 140-1 may have an opposing closed end 140-1 defined by conductive structures 154. Slot 140-2 may be continuous with gap 18-3 in peripheral conductive housing sidewalls 12W such that slot 140-2 is an open slot having an open end formed by gap 18-3 (e.g., a single piece of dielectric material may be used to fill both slot 140-2 and gap 18-3). Slot 140-2 may have an opposing closed end defined by conductive structures 154. Slot 140-3 may be continuous with gap 18-2 in peripheral conductive housing sidewalls 12W such that slot 140-3 is an open slot having an open end formed by gap 18-2 (e.g., a single piece of dielectric material may be used to fill both slot 140-3 and gap 18-2). Slot 140-3 may have an opposing closed end defined by conductive structures 156.

In one suitable arrangement, slots 140-1, 140-2, and 140-3 may be formed from a single continuous dielectric-filled slot at the exterior of device 10 (e.g., where a single continuous piece of dielectric material is used to fill slots 140-1, 140-2, 140-3, gap 18-1, gap 18-2, and gap 18-3). In this scenario, conductive structures 154 and 156 may be formed at the interior of device 10 and serve to electrically divide the continuous dielectric-filled slot into separate slots 140-1, 140-2, and 140-3 (e.g., at the interior of device 10).

Slot 140-1 may have an elongated length 186 (e.g., length L of FIG. 5) extending from its open end (e.g., gap 18-1) to its opposing closed end (e.g., conductive structures 154). Slot 140-2 may have an elongated length 188 extending from its open end (e.g., gap 18-3) to its opposing closed end (e.g., conductive structures 154). Slot 140-3 may have an elongated length 190 extending from its open end (e.g., gap 18-3) to its opposing closed end (e.g., conductive structures 156). Elongated lengths 186, 188, and 190 may, if desired, include the vertical height of gaps 18-1, 18-3, and 18-2, respectively (e.g., the lengths of gaps 18-1, 18-3, and 18-2 extending up the vertical height of peripheral conductive housing sidewalls 12W parallel with the Z-axis of FIG. 6 and from conductive rear housing wall 12R to display 14 as shown by gaps 18 in FIG. 1).

Antenna 40-1, 40-2, and 40-3 may each be fed using a corresponding antenna feed 112 (FIG. 5). For example, antenna 40-1 may be fed using antenna feed 112-1 coupled across slot 140-1. Antenna feed 112-1 may include a positive antenna feed terminal 98-1 coupled to segment 178 of peripheral conductive housing sidewall 12W and a ground antenna feed terminal 100-1 coupled to conductive layer 150. Antenna 40-2 may be fed using antenna feed 112-2 coupled across slot 140-2. Antenna feed 112-2 may include a positive antenna feed terminal 98-2 coupled to segment 178 of peripheral conductive housing sidewall 12W and a ground antenna feed terminal 100-2 coupled to conductive layer 150. Antenna 40-3 may be fed using antenna feed 112-3 coupled across slot 140-3. Antenna feed 112-3 may include a positive antenna feed terminal 98-3 coupled to segment 178 of peripheral conductive housing sidewall 12W and a ground antenna feed terminal 100-3 coupled to conductive layer 150. Antenna feed 12-1 may be coupled to transceiver circuitry 24 by transmission line 92-1, antenna feed 112-2 may be coupled to transceiver circuitry 24 by transmission line 92-2, and antenna feed 112-3 may be coupled to transceiver circuitry 24 by transmission line 92-3 (FIG. 4).

Elongated length 186 of slot 140-1 may be selected so that antenna 40-1 radiates in first and second frequency bands such as the cellular midband from 1700 MHz to 2200 MHz and the cellular telephone high band from 2300 MHz to 2700 MHz. Elongated length 188 of slot 140-2 may be selected so that antenna 40-2 radiates in first and second frequency bands (e.g., the same frequency bands as antenna 40-1) such as the cellular midband from 1700 MHz to 2200 MHz and the cellular telephone high band from 2300 MHz to 2700 MHz. For example, elongated lengths 186 and 188 may be approximately equal to one-quarter of the wavelength of operation of antennas 40-1 and 40-2 (e.g., one-quarter of the wavelength corresponding to a frequency in the cellular midband or high band).

If desired, adjustable components such as adjustable components 180 and 182 (e.g., adjustable components such as tunable components 102 of FIG. 3) may tune the frequency responses of antennas 40-1 and 40-2, respectively, to cover any desired frequency across both the cellular midband and the cellular high band (e.g., so that the total effective bandwidth of antennas 40-1 and 40-2 extends across both frequency bands). Adjustable components 180 may include switches coupled to fixed components such as inductors for providing adjustable amounts of inductance or an open circuit between conductive layer 150 and peripheral conductive housing sidewalls 12W. Components 180 and 182 may also include fixed components that are not coupled to switches or a combination of components that are coupled to switches and components that are not coupled to switches. These examples are merely illustrative and, in general, components 180 and 182 may include other components such as adjustable return path switches, switches coupled to capacitors, or any other desired components (e.g., resistors, capacitors, inductors, and/or inductors arranged in any desired manner).

Component 180 may have a first terminal coupled to segment 178 and a second terminal coupled to conductive layer 150. The first terminal of component 180 may be interposed on segment 178 between gap 18-1 and positive antenna feed terminal 98-1. The second terminal of component 180 may be interposed on conductive layer 150 between gap 18-1 and ground antenna feed terminal 100-1.

Component 182 may have a first terminal coupled to segment 178 and a second terminal coupled to conductive layer 150. The first terminal of component 182 may be interposed on segment 178 between gap 18-3 and positive antenna feed terminal 98-2. The second terminal of component 182 may be interposed on conductive layer 150 between conductive structures 156 and ground antenna feed terminal 100-2. Ground antenna feed terminal 100-2 may be interposed on conductive layer 150 between the second terminal of component 182 and conductive structures 154.

Elongated length 190 of slot 140-3 may be selected so that antenna 40-3 radiates in a third frequency band such as the cellular low band from 600 MHz to 960 MHz. For example, elongated 190 may be approximately equal to one-quarter of the wavelength of operation of antennas 40-3 (e.g., one-quarter of the wavelength corresponding to a frequency in the cellular low band).

If desired, adjustable components such as adjustable component 184 (e.g., an adjustable component such as a tunable component 102 of FIG. 3) may tune the frequency response of antenna 40-3 to cover any desired frequency across the cellular low band (e.g., so that the total effective bandwidth of antennas 40-3 extends across the cellular low band). Adjustable component 184 may include switches coupled to fixed components such as inductors for providing adjustable amounts of inductance or an open circuit between conductive layer 150 and peripheral conductive housing sidewalls 12W. Component 184 may also include fixed components that are not coupled to switches or a combination of components that are coupled to switches and components that are not coupled to switches. These examples are merely illustrative and, in general, component 184 may include other components such as adjustable return path switches, switches coupled to capacitors, or any other desired components (e.g., resistors, capacitors, inductors, and/or inductors arranged in any desired manner).

Component 184 may have a first terminal coupled to segment 176 and a second terminal coupled to conductive layer 150. The first terminal of component 184 may be interposed on segment 176 between gap 18-2 and positive antenna feed terminal 98-3. The second terminal of component 184 may be interposed on conductive layer 150 between gap 18-2 and ground antenna feed terminal 100-3.

In the example of FIG. 6, slots 140-1 and 140-3 have meandering shapes that conform to the corners of device 10 whereas slot 140-2 has a rectangular shape that extends parallel to the top edge of device 10). This example is merely illustrative. In general, slots 140-1, 140-2, and 140-3 may be straight or may have any desired shape having any desired number of segments and straight and/or curved edges. While the example of FIG. 6 shows antennas 40-1, 40-2, and 40-3 formed within region 22 at the upper end of device 10, similar structures may additionally or alternatively be formed within region 20 at the lower end of device 10 if desired (e.g., to form antennas 40-6, 40-5, and 40-4 of FIG. 4, respectively).

When configured in this way, antennas 40-1 and 40-2 may perform 2× MIMO operations in the cellular midband and/or the cellular high band with each other or with one of antennas 40-5 and 40-6 of FIG. 4. In another suitable arrangement, antennas 40-1 and 40-2 may perform 4× MIMO operations in the cellular midband and/or the cellular high band with both antennas 40-5 and 40-6 of FIG. 4. Antenna 40-3 may perform 2× MIMO operations in the cellular low band with antenna 40-4 of FIG. 4. This may allow the antennas in device 10 to maximize the possible data throughput for wireless communications circuitry 34. At the same time, forming antennas 40-1, 40-2, and 40-3 in this way (e.g., conforming to the edges of housing 12 and/or defining edges of slots 140-1, 140-2, and 140-3 by peripheral conductive housing sidewalls 12W) may allow the antennas to occupy a minimal amount of area in the X-Y plane of FIG. 6, thereby serving to maximize the possible active area AA for display 14 (FIG. 1).

Figure 7:
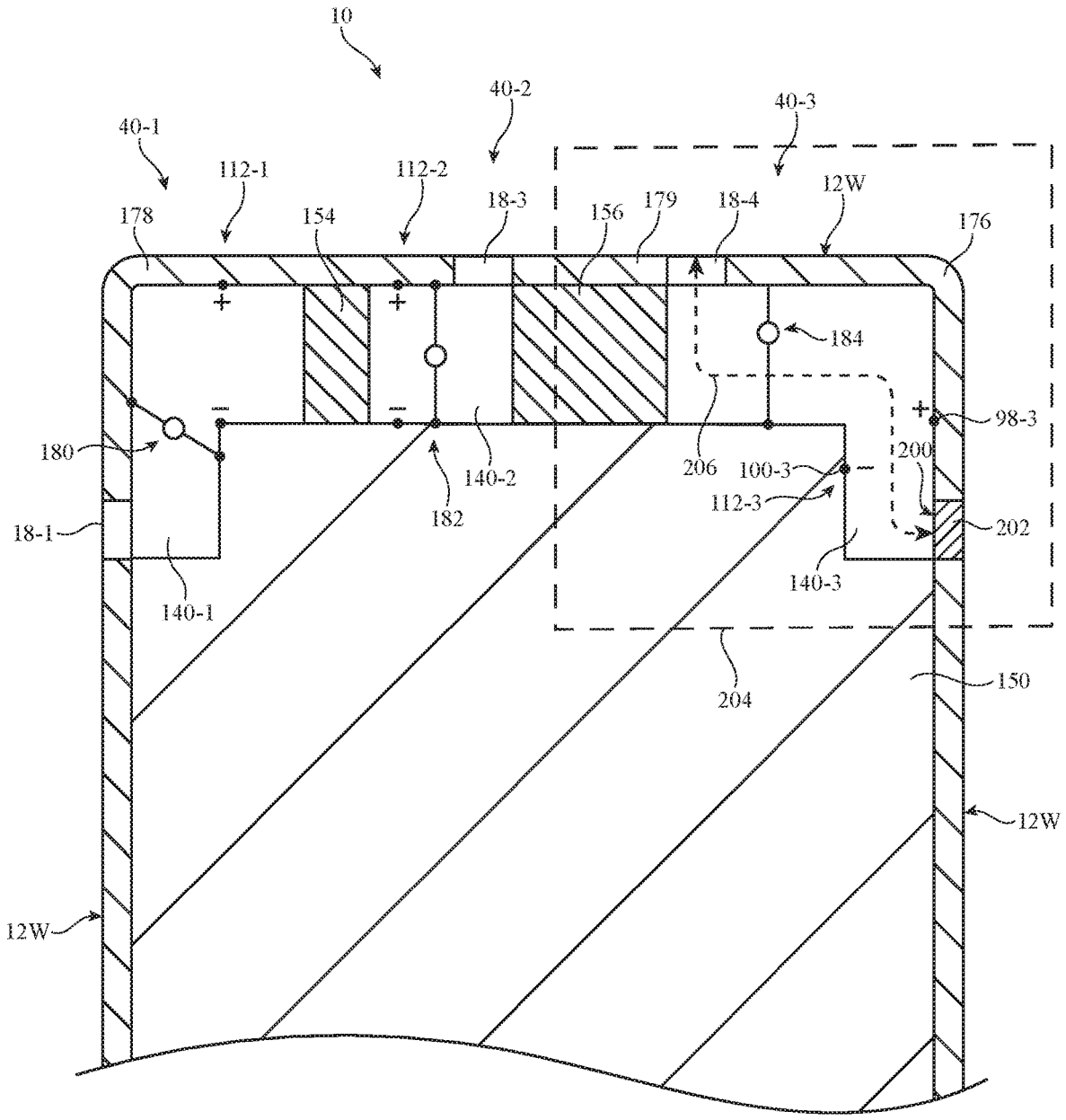

In practice, the antenna efficiency of antennas 40-1, 40-2, and 40-3 in a free space environment (e.g., an environment in which device 10 is not being held by a user) may be limited due to the close proximity of antenna feed 112-3 to antenna 40-2 (e.g., as shown in FIG. 6). In order to optimize free space antenna efficiency, antenna feed 112-3 may be located on the right side of device 10 and an additional dielectric-filled gap may be formed in peripheral conductive housing structures 12W (e.g., to help isolate antenna feed 112-3 of antenna 40-3 from antenna 40-2). FIG. 7 is a top interior view of device 10 showing how feed 112-3 may be located at the right side of device 10 and an additional dielectric-gap may be used to isolate feed 112-3 from antenna 40-2.

As shown in FIG. 7, peripheral conductive housing sidewalls 12W at the top side of device 10 may include an additional dielectric-filled gap 18-4. Dielectric-filled gap 18-4 my divide peripheral conductive housing sidewalls 12W and may separate segment 176 from an additional segment 179 of peripheral conductive housing sidewalls 12W. Gap 18-3 may separate segment 179 from segment 178 of peripheral conductive housing sidewalls 12W. Conductive structures 156 may couple segment 179 to conductive layer 150.

Gap 18-4 may be filled with plastic, ceramic, sapphire, glass, epoxy, or other dielectric materials. The dielectric material in gaps 18-4 may lie flush with peripheral conductive housing 12W. Slot 140-3 may be continuous with gap 18-4 in peripheral conductive housing sidewalls 12W such that slot 140-3 is an open slot having an open end at gap 18-4 (e.g., a single piece of dielectric material may be used to fill both slot 140-3 and gap 18-4). Slot 140-3 may have an opposing closed end 200 defined by conductive structures 202 (e.g., conductive structures 202 may be formed in the place of dielectric gap 18-2 of FIG. 6). Conductive structures 202 may, for example, be an integral portion of peripheral conductive housing sidewall 12W (e.g., segment 176 and conductive structures 202 may be formed from a single continuous piece of metal). In another suitable arrangement, conductive structures 202 may include a conductive short path or an adjustable component (e.g., an adjustable component such as tunable component 102 of FIG. 3) that electrically forms closed end 200 of slot 140-3 (e.g., while still forming dielectric-filled gap 18-2 of FIG. 6 in peripheral conductive housing sidewalls 12W).

In the example of FIG. 7, slot 140-3 has an elongated length 206 (e.g., length L of FIG. 5) extending from its open end (e.g., gap 18-4) to its opposing closed end 200 (e.g., conductive structures 202). Elongated length 206 may, if desired, include the vertical height of gap 18-4 (e.g., the length of gap 18-4 extending up the vertical height of peripheral conductive housing sidewalls 12W parallel with the Z-axis of FIG. 7 and from conductive rear housing wall 12R to display 14 as shown by gaps 18 in FIG. 1). Elongated length 206 of slot 140-3 may be selected so that antenna 40-3 radiates in the frequency band such as the cellular low band from 600 MHz to 960 MHz. For example, elongated length 206 may be approximately equal to one-quarter of the wavelength of operation of antenna 40-3 (e.g., one-quarter of the wavelength corresponding to a frequency in the cellular low band).

In the example of FIG. 7, slot 140-3 has a meandering shape that conforms to the corner of device 10. This example is merely illustrative. In general, slots 140-1, 140-2, and 140-3 may be straight or may have any desired shape having any desired number of segments and straight and/or curved edges. While the example of FIG. 7 shows antennas 40-1, 40-2, and 40-3 formed within region 22 at the upper end of device 10, similar structures may additionally or alternatively be formed within region 20 at the lower end of device 10 if desired (e.g., to form antennas 40-6, 40-5, and 40-4 of FIG. 4, respectively).

In this way, antenna feed 112-3 may be moved to a location farther away from antenna 40-2 than the arrangement shown in FIG. 6. The presence of gap 18-4 in addition to gap 18-3 between antenna feed 112-2 of antenna 40-2 and antenna feed 112-3 of antenna 40-3 may serve to increase isolation between the antennas and may thus increase the overall antenna efficiency for the antennas in a free space scenario (sometimes referred to herein as a free space environment). However, in some scenarios when the user of device 10 is holding device 10 in their hands (sometimes referred to herein as grip scenarios or grip environments), the user's hand may load the impedance of antenna 40-3 and may thus detune the coverage of antenna 40-3 in the cellular low band. For example, when a user holds device 10 in a landscape orientation, the user's palm may load antenna 40-3 adjacent to gap 18-4 generating low band detuning. If desired, antenna 40-3 may be provided with multiple antenna feeds and additional adjustable circuitry to help antenna 40-3 to exhibit satisfactory antenna efficiency regardless of whether device 10 is being operated in a grip or free space environment.

Figure 8:
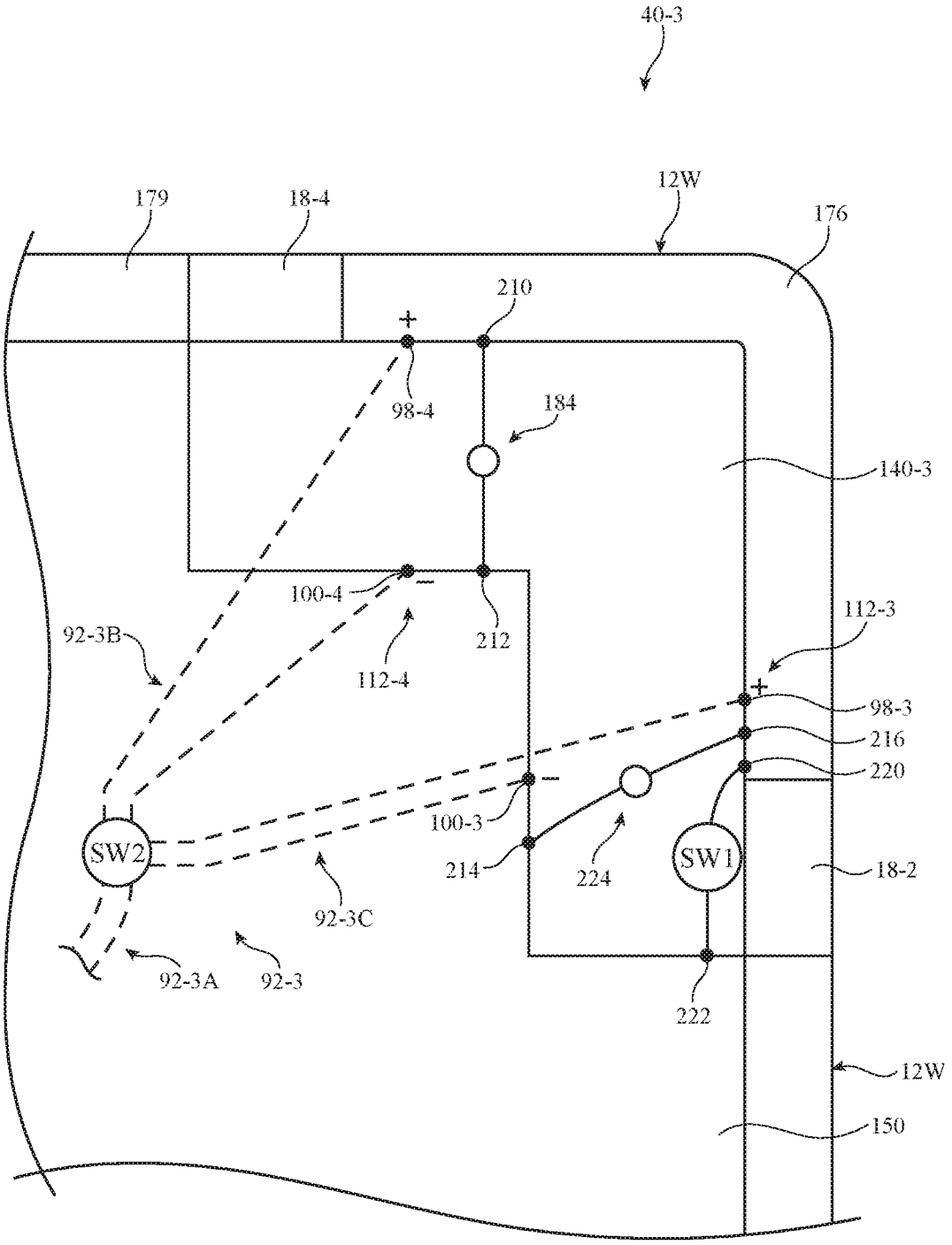
FIG. 8 is a top view of an illustrative slot antenna having multiple feeds and multiple tuning settings for redistributing electromagnetic field hot spots in accordance with an embodiment.

FIG. 8 is a top interior view of antenna 40-3 (e.g., within dashed box 204 of FIG. 7) showing how antenna 40-3 may be provided with multiple antenna feeds and adjustable circuitry for mitigating cellular low band detuning regardless of operating environment. As shown in FIG. 8, antenna 40-3 may include an additional antenna feed 112-4 coupled across slot 140-3. Positive antenna feed terminal 98-4 of antenna feed 112-4 may be coupled to segment 176 of peripheral conductive housing sidewalls 12W. Ground antenna feed terminal 100-4 of antenna feed 112-4 may be coupled to conductive layer 150.

An additional adjustable component 224 may be coupled across slot 140-3. Adjustable component 224 may have a first terminal 216 coupled to segment 176 and a second terminal 214 coupled to conductive layer 150. Adjustable component 224 may include switches coupled to fixed components such as inductors for providing adjustable amounts of inductance or an open circuit between conductive layer 150 and peripheral conductive housing sidewalls 12W. Adjustable component 224 may also include fixed components that are not coupled to switches or a combination of components that are coupled to switches and components that are not coupled to switches. These examples are merely illustrative and, in general, component 224 may include other components such as adjustable return path switches, switches coupled to capacitors, or any other desired components (e.g., resistors, capacitors, inductors, and/or inductors arranged in any desired manner).

In the example of FIG. 8, gap 18-2 is formed within peripheral conductive housing wall 12W (e.g., as shown in FIG. 6). An adjustable component such as switch SW1 may be coupled across slot 140-3. Switch SW1 may have a first terminal 220 coupled to segment 176 and a second terminal 222 coupled to conductive layer 150 at or adjacent to dielectric-filled gap 18-2. When switch SW1 is turned on (closed), switch SW may form a short circuit path between terminals 220 and 222 (e.g., switch SW1 may serve as conductive structures 202 of FIG. 7 and the short circuit path through switch SW1 may electrically form closed end 200 of slot 140-3 across dielectric-filled gap 18-2). When switch SW1 is turned off (opened), switch SW1 may form an open circuit between terminals 220 and 222. When switch SW1 is turned off, slot 140-3 may have an open end at gap 18-2 (e.g., the elongated length of slot 140-3 may be adjusted to include the vertical height of gap 18-2).

The example in which switch SW1 is coupled between terminals 222 and 220 is merely illustrative. If desired, an adjustable component that include switches coupled to fixed components such as inductors for providing adjustable amounts of inductance or an open circuit may be coupled between terminals 222 and 220. In general, any desired fixed and/or adjustable components (e.g., resistors, capacitors, inductors, switches, etc.) may be coupled between terminals 222 and 220.

As shown in FIG. 8, adjustable component 184 may have a first terminal 210 coupled to segment 176 of peripheral conductive housing sidewall 12W and a second terminal 212 coupled to conductive layer 212. Positive antenna feed terminal 98-4 may be interposed on segment 176 between gap 18-4 and terminal 210 of adjustable component 184. Terminal 210 of adjustable component 184 may be interposed between positive antenna feed terminal 98-4 and positive antenna feed terminal 98-3. Positive antenna feed terminal 98-4 may be interposed between terminal 210 of adjustable component 184 and terminal 216 of adjustable component 224. Terminal 216 of adjustable component 224 may be interposed between terminal 220 of switch SW1 and positive antenna feed terminal 98-3. Terminal 220 of switch SW1 may be interposed between terminal 216 of adjustable component 224 and gap 18-2.

Similarly, ground antenna feed terminal 100-4 may be interposed between terminal 212 of adjustable component 184 and gap 18-4. Terminal 212 of adjustable component 184 may be interposed between ground antenna feed terminal 100-4 and ground antenna feed terminal 100-3. Ground antenna feed terminal 100-3 may be interposed between terminal 212 of adjustable component 184 and terminal 214 of adjustable component 224. Terminal 214 of adjustable component 224 may be interposed between ground antenna feed terminal 100-3 and terminal 222 of switch SW1. Terminal 222 of switch SW1 may be interposed between terminal 214 of adjustable component 224 and gap 18-2. The example of FIG. 8 is merely illustrative and, if desired, these terminals may be arranged in different orders.

Transmission line 92-3 for antenna 40-3 may include a first portion 92-3A coupled to transceiver circuitry 24 (FIG. 4), a second portion 92-3B coupled to antenna feed 112-4, and a third portion 92-3C coupled to antenna feed 112-3. Portions 92-3A, 92-3B, and 92-3C of transmission line 92-3 may be coupled to switching circuitry such as switch SW2. Switch SW2 may have a first state at which portion 92-3A is coupled to portion 92-3B and a second state at which portion 92-3A is coupled to portion 92-3B.

During operation, control circuitry 28 (FIG. 3) may provide control signals to control the states of switch SW1, switch SW2, adjustable component 184, and adjustable component 224 (sometimes referred to herein collectively as the tuning settings or antenna tuning settings for antenna 40-3) to ensure that antenna 40-3 operates as desired regardless of the operating environment for device 10. For example, control circuitry 28 may control switch SW2 to activate (enable) antenna feed 112-4 and deactivate (disable) antenna feed 112-3 (e.g., by controlling switch SW2 to couple portion 92-3A to portion 92-3B and to decouple portion 92-3A from portion 92-3C) or to activate antenna feed 112-3 and deactivate antenna feed 112-4 (e.g., by controlling switch SW2 to couple portion 92-3A to portion 92-CB and to decouple portion 92-3A from portion 92-3B). Control circuitry 28 may perform any desired combination of selectively activating one of antenna feeds 112-3 and 112-4, adjusting component 184, adjusting component 224, and opening or closing switch SW1 to ensure that antenna 40-3 operates with satisfactory antenna efficiency regardless of the operating environment for device 10.

As one example, control circuitry 28 may operate antenna 40-3 in a first mode of operation or state in which control circuitry 28 closes switch SW1, activates antenna feed 112-3, deactivates antenna feed 112-4, and tunes the frequency response of antenna 40-3 in the cellular low band using adjustable component 184. In this mode, slot 140-3 is an open slot having an open end defined by gap 18-4 and having an opposing closed end defined by closed switch SW1 (e.g., antenna 40-3 may electrically form the arrangement shown in FIG. 7). In this mode, a relatively high magnitude electric field (e.g., an electromagnetic hotspot) is established at gap 18-4.

As another example, control circuitry 28 may operate antenna 40-3 in a second mode of operation or state in which switch SW1 is open, antenna feed 112-4 is active (enabled), antenna feed 112-3 is disabled, and adjustable component 224 tunes the frequency response of antenna 40-3 in the cellular low band. In this mode, slot 140-3 is an open slot having a first open end defined by gap 18-4 and a second open end defined by gap 18-2 (e.g., antenna 40 may be configured as an inverted-F antenna having a return path formed by adjustable component 224). In this mode, the relatively high magnitude electric field at gap 18-4 in the first mode may be redistributed across both gaps 18-4 and 18-2. This may reduce the impact on (i.e., the loading of) antenna 40-3 when a user's palm is located adjacent to gap 18-4 (e.g., when device 10 is in a grip scenario and the user is holding relative device 10 in a landscape orientation). In other words, antenna 40-3 may, for example, greater antenna efficiency in the cellular low band in the first mode when device 10 is in a free space environment than in the second mode. Similarly, antenna 40-3 may exhibit greater antenna efficiency in the cellular low band in the second mode when device 10 is in a grip environment than in the first mode. Control circuitry 28 may place antenna 40-3 in a selected one of the first and second modes based on information about the operating environment of device 10 and/or the wireless performance of antenna 40-3 to optimize the wireless performance antenna 40-3 at any given time. These examples are merely illustrative and, in general, any desired combination of these adjustments may be performed to optimize wireless performance for antenna 40-3.

The example of FIG. 8 is merely illustrative. If desired, gap 18-2 may be replaced by a continuous portion of peripheral conductive housing sidewalls 12W (e.g., so that slot 140-3 always has a closed end such as closed end 200 of FIG. 7). Additional adjustable components may be coupled to slot 140-3. More than two antenna feeds may be used if desired. Similar structures may be used to form antenna 40-4 at lower end 20 of device 10 if desired (FIG. 4).

Figure 9:
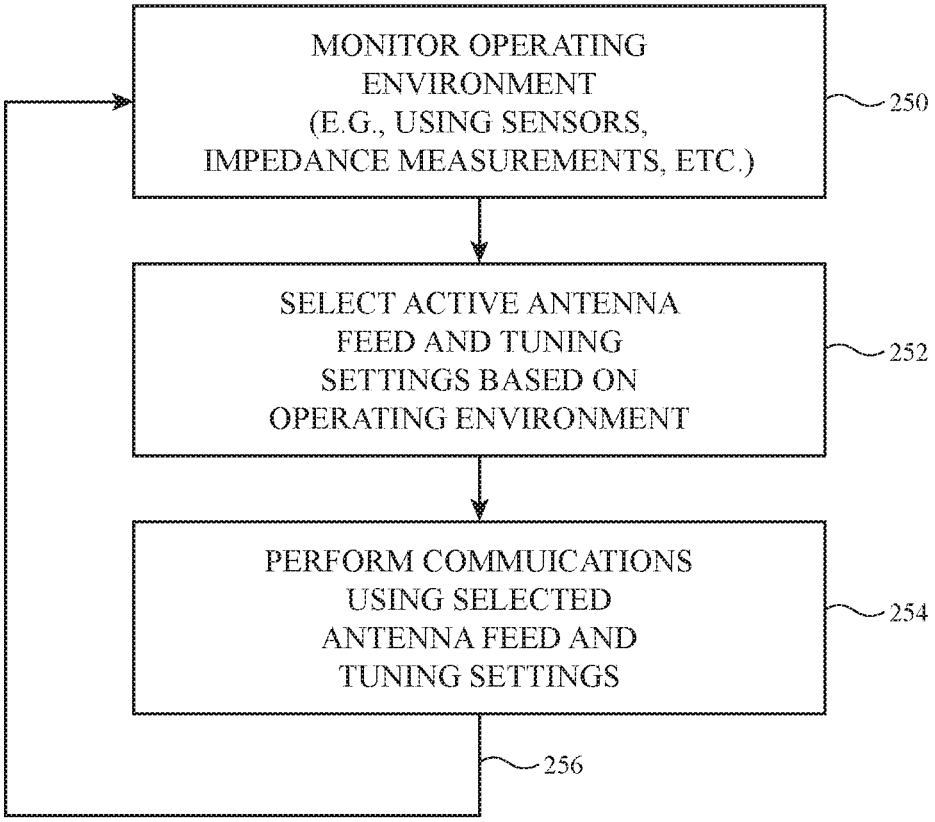
FIG. 9 is a flow chart of illustrative steps that may be involved in operating an electronic device having antenna of the type shown in FIG. 8 in accordance with an embodiment.

FIG. 9 is a flow chart of illustrative steps involved in operating antenna 40-3 to ensure satisfactory wireless performance regardless of how a user is holding device 10.

At step 250 of FIG. 7, control circuitry 28 may monitor the operating environment of device 10. Control circuitry 28 may, in general, use any suitable type of sensor measurements, wireless signal measurements, operation information, or antenna measurements to determine how device 10 is being used (e.g., to determine the operating environment of device 10). For example, control circuitry 28 may use sensors such as temperature sensors, capacitive proximity sensors, light-based proximity sensors, resistance sensors, force sensors, touch sensors, connector sensors that sense the presence of a connector in a connector port or that detect the presence or absence of data transmission through a connector port, sensors that detect whether wired or wireless headphones are being used with device 10, sensors that identify a type of headphone or accessory device that is being used with device 10 (e.g., sensors that identify an accessory identifier identifying an accessory that is being used with device 10), or other sensors to determine how device 10 is being used.

Control circuitry 28 may also use information from an orientation sensor such as an inertial sensor (e.g., accelerometer), gyroscope, and/or compass in device 10 to help determine whether device 10 is being held in a portrait orientation, a reverse portrait orientation, a landscape orientation, or a reverse landscape orientation. A user may be statistically likely to be holding device 10 in a particular manner (e.g., with the user's hands nearby to corresponding antennas 40) based on the present orientation of device 10. This information may be used to predict which antennas are likely to be loaded and thus detuned by the presence of the user's hands, for example.

If desired, control circuitry 28 may also use information about a usage scenario of device 10 in determining how device 10 is being used (e.g., information identifying whether audio data is being transmitted particular speakers of device 10, information identifying whether a telephone call is being conducted, information identifying whether a microphone on device 10 is receiving voice signals, etc.).

If desired, impedance sensors or other sensors may be used in monitoring the impedance of antenna 40-3. Different operating environments may load antenna 40 differently, so impedance measurements may help determine whether device 10 is being gripped in a manner that causes antenna 40-3 to be loaded and detuned by the user's hand. Another way in which control circuitry 28 may monitor antenna loading conditions involves making received signal strength measurements or other wireless performance metric measurements (e.g., error rate measurements, signal to noise ratio measurements, noise measurements, etc.) on radio-frequency signals being received with antenna 40-3.

In general, any desired combinations of one or more of these measurements or other measurements may be processed by control circuitry 28 to identify how device 10 is being used (i.e., to identify the operating environment of device 10). Such information may be indicative of the present operating conditions of device 10 (e.g., gathered data indicative of which antennas are currently being loaded and detuned by a user's hands) and/or may be predictive of which antennas are likely to be loaded and detuned by a user's hands.

At step 252, control circuitry 28 may activate a selected one of antenna feeds 112-3 and 112-4 and may adjust the tuning settings (e.g., settings for components 184, 224, and SW1 of FIG. 8) based on the current operating environment of device 10 (e.g., based on data or information gathered while processing step 250). For example, control circuitry 28 may process the data gathered while processing step 250 to determine whether device 10 is being held in a portrait orientation, a reverse portrait orientation, a landscape orientation, or a reverse landscape orientation, or whether device 10 is being held in a particular manner in which antenna 40-3 is being loaded and thus detuned by external objects such as the user's hands.

At step 254, antenna 40-3 may transmit and/or receive wireless data (e.g., using a 2× MIMO scheme with antenna 40-4 of FIG. 4) using the active antenna feed and the selected antenna tuning settings (e.g., as selected while processing step 252). This process may be performed continuously, as indicated by line 256.

FIG. 9 is a graph in which antenna performance (antenna efficiency) has been plotted as a function of operating frequency F for antennas 40-1, 40-2, 40-3, 40-4, 40-5, and 40-6 of FIGS. 4 and 8. As shown in FIG. 9, curve 300 plots the antenna efficiency of the antennas when operated at a satisfactory antenna efficiency level. Antennas 40-3 and 40-4 may contribute a response in a first band such as cellular low band LB (e.g., a frequency band between 600 MHz and 960 MHz). Antennas 40-1, 40-2, 40-5, and 40-6 may contribute a response in a second band such as cellular midband MB (e.g., a frequency band between 1700 MHz and 2200 MHz) and a third band such as cellular high band HB (e.g., a frequency band between 2300 MHz and 2700 MHz).

When device 10 is operating in a free space environment and antenna 40-3 is operating using antenna feed 112-3, the antennas may exhibit a satisfactory antenna efficiency as shown by curve 300. However, if device 10 enters a grip environment (e.g., when a user holds device 10 in a landscape orientation), antenna 40-3 may exhibit deteriorated performance in cellular low band LB as shown by curve 302. Control circuitry 28 may adjust antenna 40-3 (e.g., while processing step 252 of FIG. 9) to compensate for this change in loading. For example, control circuitry 28 may activate antenna feed 112-4 for antenna 40-3 to redistribute electromagnetic hot spots across both gaps 18-4 and 18-3 (FIG. 8). This may mitigate loading by the user's hand in the grip environment, shifting the antenna efficiency back to curve 300. In this way, the antennas in device 10 may operate with satisfactory antenna efficiency across multiple frequency bands regardless of operating environment. The antennas may perform MIMO operations at one or more frequencies in midband MB, low band LB, and/or high band HB.

Figure 10:
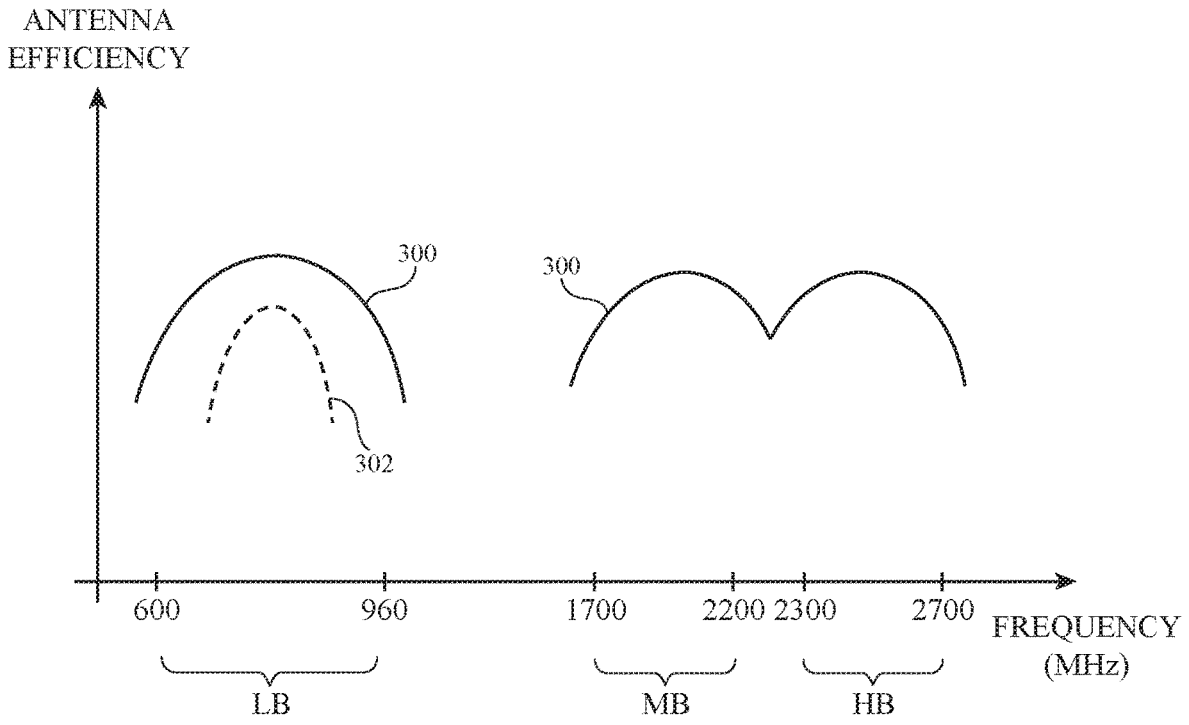
FIG. 10 is a plot of antenna performance (antenna efficiency) as a function of frequency for multiple illustrative antennas of the types shown in FIGS. 6-8 in accordance with an embodiment.

The example of FIG. 10 is merely illustrative. In practice, curves 300 and 302 may have different shapes (e.g., curve 300 may continuously extend across both MB and HB). Antennas 40 may exhibit any desired number of response peaks in any desired frequency bands.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a conductive layer;

an elongated housing having first and second opposing housing ends and having peripheral conductive structures surrounding the conductive layer;

first, second, and third dielectric-filled gaps in the peripheral conductive structures;

a first antenna located at the first housing end, wherein the first antenna includes a first slot between the conductive layer and the peripheral conductive structures and a first antenna feed coupled across the first slot, the first slot having an open end defined by the first dielectric-filled gap;

a second antenna located at the first housing end, wherein the second antenna includes a second slot between the conductive layer and the peripheral conductive structures and a second antenna feed coupled across the second slot, the second slot having an open end defined by the second dielectric-filled gap;

a first conductive structure that couples the conductive layer to the peripheral conductive structures and that defines closed ends of the first and second slots;

a third antenna located at the first housing end, wherein the third antenna includes a third slot between the conductive layer and the peripheral conductive structures and a third antenna feed coupled across the third slot, the third slot having an open end defined by the third dielectric-filled gap; and a second conductive structure that couples the conductive layer to the peripheral conductive structures and that defines a closed end of the third slot.

2. The electronic device defined in claim 1, further comprising:

radio-frequency transceiver circuitry coupled to the first, second, and third antenna feeds, wherein the radio-frequency transceiver circuitry is configured to concurrently convey radio-frequency signals at a first frequency over the first and second antennas using a multiple-input and multiple-output (MIMO) scheme, and the radio-frequency transceiver circuitry is configured to convey radio-frequency signals at a second frequency that is lower than the first frequency over the third antenna.

3. The electronic device defined in claim further comprising:

a first conductive structure that couples the conductive layer to the peripheral conductive structures and that separates the first slot from the second slot; and a second conductive structure that couples the conductive layer to the peripheral conductive structures and that separates the second slot from the third slot.

4. The electronic device defined in claim 3, wherein the second conductive structure comprises a conductive portion of an electronic component selected from the group consisting of: a camera module and a data port.

5. The electronic device defined in claim 1, wherein the peripheral conductive structures comprise first, second, and third conductive walls, the second conductive wall extends from the first conductive wall to the third conductive wall, the first conductive wall extends parallel to the third conductive wall, the first dielectric-filled gap is formed in the first conductive wall, and the second dielectric-filled gap is formed in the second conductive wall.

6. The electronic device defined in claim 5, wherein the third dielectric-filled gap is formed in the third conductive wall.

7. The electronic device defined in claim 5, wherein the third dielectric-filled gap is formed in the second conductive wall, the second conductive structures being coupled to a portion of the second conductive wall that is interposed between the second and third dielectric-filled gaps.

8. The electronic device defined in claim 7, further comprising:

a fourth dielectric-filled gap formed in the third conductive wall, wherein a segment of the peripheral conductive structures extends from the third dielectric-filled gap to the fourth dielectric-filled gap.

9. The electronic device defined in claim 8, further comprising:

a switch coupled between an end of the segment at the fourth dielectric-filled gap and the conductive layer, wherein the switch has a first state in which the third slot has an additional open end at the fourth dielectric-filled gap and a second state in which the end of the segment is shorted to the conductive layer through the switch.

10. The electronic device defined in claim 9, wherein third antenna feed comprises a first positive antenna feed terminal coupled to a first location on the segment, the third antenna further comprising:

a first adjustable component coupled across the third slot and having a first terminal coupled to a second location on the segment;

a fourth antenna feed coupled across the third slot, wherein the fourth antenna comprises a second positive antenna feed terminal coupled to a third location on the segment;

a second adjustable component coupled across the third slot and having a second terminal coupled to a fourth location on the segment, wherein the first location is interposed between the third dielectric-filled gap and the second location, the second location is interposed between the first and third locations, the third location is interposed between the second and fourth locations, and the fourth location is interposed between the third location and the fourth dielectric-filled gap; and control circuitry configured to activate a selected one of the third and fourth antenna feeds at a given time.

11. An electronic device comprising:

a housing having a peripheral conductive wall;

a dielectric-filled gap in the peripheral conductive wall that divides the peripheral conductive wall into first and second segments, wherein the first segment has a first end at the dielectric-filled gap and a second end that opposes the first end;

an antenna ground separated from the peripheral conductive wall by a slot;

a first antenna having a first antenna feed coupled between a first location on the first segment and the antenna ground across the slot;

a second antenna having a second antenna feed coupled between a second location on the first segment and the antenna ground across the slot;

a first adjustable component coupled between a third location on first segment and the antenna ground, wherein the third location is interposed between the second location and the first end;

a second adjustable component coupled between a fourth location on first segment and the antenna ground, wherein the fourth location is interposed between the first location and the second end;

a third antenna having a third antenna feed coupled between the second segment and the antenna ground across the slot, wherein the second antenna is interposed between the first and third antennas.

12. The electronic device defined in claim 11, further comprising:

a first conductive structure that bridges the slot and couples the antenna ground to the first segment, wherein the first conductive structure is interposed between the first and second antenna feeds and the second antenna feed is interposed between the conductive structure and the dielectric-filled gap.

13. The electronic device defined in claim 12, further comprising:

a second conductive structure that bridges the slot and couples the antenna ground to the second segment, wherein the second conductive structure is interposed between the dielectric-filled gap and the third antenna feed.

14. The electronic device defined in claim 13, wherein the first antenna feed comprises a first positive antenna feed terminal, the second antenna feed comprises a second positive antenna feed terminal, the third antenna feed comprises a third positive antenna feed terminal, the first adjustable component has a first terminal coupled to the first segment and a second terminal coupled to the antenna ground, and the first terminal is interposed on the first segment between the second positive antenna feed terminal and the dielectric-filled gap.

15. The electronic device defined in claim 14, wherein the second segment has a first end at the dielectric-filled gap and a second end that opposes the first end of the second segment, and the second adjustable component has a third terminal coupled to the first segment and a fourth terminal coupled to the antenna ground, the electronic device further comprising:

a third adjustable component that has a fifth terminal coupled to the second segment and a sixth terminal coupled to the antenna ground, wherein the fifth terminal is interposed between the third positive antenna feed terminal and the second end of the second segment.

16. The electronic device defined in claim 13, wherein the second conductive structure comprises a conductive portion of an electronic component selected from the group consisting of: a camera module mounted in the housing and a data port mounted in the housing.

17. The electronic device defined in claim 11, wherein the first and second antennas are configured to concurrently convey radio-frequency signals at a first frequency using a multiple-input and multiple-output (MINO) scheme, and the second antenna is configured to convey radio-frequency signals at a second frequency that is lower than the first frequency.

18. An electronic device comprising:

peripheral conductive housing structures that include a segment extending between first and second dielectric-filled gaps in the peripheral conductive housing structures;

an antenna that comprises:

an antenna ground, a slot that extends from the first dielectric-filled gap to the second dielectric field gap and that has edges defined by the segment of the peripheral conductive housing structures and the antenna ground, the slot having a first open end defined by the first dielectric-filled gap, an antenna feed coupled between the segment and the antenna ground, and a switch coupled between the segment and the antenna ground; and control circuitry configured to place the antenna into a selected one of a first state in which the first antenna feed is active, the switch forms an open circuit between the segment and the antenna ground, and the slot has a second open end defined by the second dielectric-filled gap, and a second state in which the first antenna feed is inactive, the switch forms a short circuit path between the segment and the antenna ground, and the short circuit path forms a closed end of the slot across the second dielectric-filled gap.

19. The electronic device defined in claim 18, wherein the antenna feed is coupled to a first location on the segment and the switch is coupled to a fifth location on the segment, the antenna further comprising:

a first adjustable component coupled between a second location on the segment and the antenna ground, the first location being interposed between the first dielectric-filled gap and the second location;

an additional antenna feed coupled between a third location on the segment and the antenna ground, the second location being interposed between the first and third locations; and a second adjustable component coupled between a fourth location on the segment and the antenna ground, the third location being interposed between the second and fourth locations, and the fifth location being interposed between the fourth location and the second dielectric filled gap, wherein:

in the first state of the antenna, the second antenna feed is inactive and the second adjustable component is configured to tune a frequency response of the slot, and in the second state of the antenna, the second antenna feed is active and the first adjustable component is configured to tune the frequency response of the slot.

* * * * *